United States Patent [19]

Ferri, Jr. et al.

[11] Patent Number: 4,608,039

[45] Date of Patent: Aug. 26, 1986

[54] ENVELOPE FOLDING SYSTEM

[75] Inventors: Edward T. Ferri, Jr., Morgan Hill; Paul E. Seaborn, Los Gatos, both of Calif.

[73] Assignee: Seaborn Development, Inc., Campbell, Calif.

[21] Appl. No.: 599,855

[22] Filed: Apr. 13, 1984

[51] Int. Cl.[4] ..... B31B 1/28

[52] U.S. Cl. ..... 493/164; 493/247; 493/252; 493/946; 156/443; 156/227; 264/339

[58] Field of Search ..... 493/163, 164, 246, 247, 493/252, 416, 417, 946, 251, 243, 209, 250, 252, 260, 397, 399; 156/227, 216, 217, 443, 492; 264/339; 425/383, 397; 53/563

[56] References Cited

U.S. PATENT DOCUMENTS

| | | | |
|---|---|---|---|
| 3,574,294 | 4/1971 | Egli | 493/164 |
| 3,905,280 | 9/1975 | Egleston et al. | 493/164 |
| 4,304,621 | 12/1981 | Appoldt et al. | 156/227 |
| 4,347,091 | 8/1982 | Hauck et al. | 156/443 |
| 4,367,117 | 1/1983 | Seaborn | 156/443 |
| 4,415,325 | 11/1983 | Fuchs et al. | 264/330 |
| 4,454,743 | 6/1984 | Bulso, Jr. et al. | 72/405 |

*Primary Examiner*—Lowell A. Larson
*Assistant Examiner*—David B. Jones
*Attorney, Agent, or Firm*—Townsend & Townsend

[57] ABSTRACT

An apparatus for folding envelope blanks comprises a plurality of platform assemblies which are rotatably mounted on a base. The platform assemblies are incrementally advanced around the base, and separate mechanisms located around the periphery of the base perform the individual folding operations. Particular advantages are achieved by including the side flap folding mechanism on the platform assemblies so that the folded flaps are held firmly in place until the envelope is removed from the machine.

10 Claims, 38 Drawing Figures

ENVELOPE FOLDING SYSTEM

BACKGROUND OF THE INVENTION

1. Field of the Invention

The present invention relates generally to machines for folding and sealing envelopes, and more particularly to a machine for folding envelopes used for encasing floppy disks.

2. Description of the Prior Art

Envelopes used for encasing floppy disks are typically formed from a plastic backing material having a fabric liner for protecting the disk media. The envelopes are folded from precut envelope blanks by making a first transverse fold along the middle of the blank and thereafter folding a pair of edge flaps to enclose two parallel edges of the envelope. The disk is inserted through the remaining open edge which is later sealed to fully enclose the disk therein. The envelope includes various holes which provide access to the disk media. A large central hole allows the disk drive mechanism to rotate the disk, while an elongate, radial slot allows the access by the read/write head of the disk drive.

Because the envelope holds the disk in place while the disk is being read it is important that the dimensions of the jacket be maintained within very close tolerances. It is also critical that the folds be made accurately in order to assure that the folded envelope remains absolutely flat after the folds have been sealed. The task of folding these envelopes is further complicated when the envelope holes are precut in the envelope blank. The holes in such precut envelope blanks must be accurately aligned after the folding is complete.

While machines have been developed which can accurately fold disk envelopes within the close tolerances required, the prior art devices are typically slow, usually requiring at least a six to eight second cycle time to produce a folded envelope ready for disk insertion. One of the fastest of these machines is the Linear Automated Primary Folding Machine, manufactured by Seaborn Development, Inc., Campbell, Calif. The Seaborn machine includes a pair of folding stations arranged on a linear track. An envelope blank is fed into one end of the machine, folded in half over an elongate mandrel located at the first station. The mandrel is then used to advance the envelope to the second folding station. At the second folding station, the side flaps on the envelope are folded over and the envelope flaps are sealed by a heat stake mechanism. Both folding operations require that the fold lines be heated prior to actual folding. The folded envelope is then removed from the machine. The cycle time for producing a folded envelope by this machine is on the order of six to eight seconds, and the machine suffers from a number of inherent limitations which prevent the reduction of the cycle time. For example, the use of the mandrel to advance the envelope prevents introduction of a new envelope blank until a previous blank has been advanced to the output area of the machine. Moreover, the side flaps must be clamped in place for at least one to three seconds after having been heated and folded in order to assure that the folds cool and set. Such clamping time prevents the advance of the envelope from the second station which in turn prevents introducing a new envelope blank at the first station.

SUMMARY OF THE INVENTION

The present invention provides an apparatus and method for accurately folding envelope blanks within very close tolerances and at a very high unit capacity. The invention is particularly useful for folding floppy disk envelopes where a cycle time of three to four seconds per unit, or better, can be achieved. The present invention is able to achieve the competing objectives of both accurate folding and high capacity by utilizing a plurality of platform assemblies for receiving and transporting individual envelope blanks between a number of stationary assemblies where single operations are performed on the envelope blanks. The platform assemblies are synchronously advanced between the stationary assemblies, and each stationary assembly is actuated simultaneously to operate on the envelope carried by the platform assembly which is present during that cycle.

At least three stationary assemblies will be provided. The first will fold the envelope blank transversely, bringing the opposed faces of the envelope together. The second stationary assembly will fold over side flaps on one of the envelope faces over onto the opposed face, and the third stationary assembly will provide means for sealing the envelope flaps to the envelope face. In the preferred embodiment, additional stationary assemblies will be provided, including a feed assembly for singulating and introducing the unfolded envelope blank, an alignment assembly for properly locating the envelope blank on the platform assembly, and an output assembly for removing the folded envelope from the apparatus. Usually, a maintenance station which allows access to the platform assembly for necessary adjustments and mounting and demounting of the platform assembly will also be provided. Optionally, two separate sealing assemblies may be provided to allow either heat staking or gluing without having to modify the folding system.

Conveniently, the platform assemblies are mounted on a circular table which in turn is rotatably mounted on a support frame. The stationary assemblies are mounted on the support frame at the periphery of the circular table, and the table may be incrementally rotated through a fixed angle to advance each platform assembly sequentially passed a particular stationary assembly.

A particular advantage of the present invention is gained by including flap folding dies on each platform assembly. The dies may be actuated by the appropriate stationary assembly between an open and a closed configuration. In the closed configuration, the side flaps of the envelope are held firmly in their folded position. In systems employing heat stakes to seal the side flaps, it is necessary that the envelope flaps be held in place for several seconds after folding before pressure is removed. This allows the heated fold lines to cool and set. In systems employing glue sealing of the side flaps, it is also necessary to clamp the flaps after folding to allow the glud to set. In either case, the prior art systems generally required that the folded envelope be left at the folding station during this setting period since the clamping means were fixedly located at a particular work station. The present invention, in contrast, allows the envelope to be moved from the folding assembly immediately after the folding operation since the side flaps of the envelope remain clamped on the platform assembly itself.

BBIEF DESCRIPTION OF THE DRAWINGS

DESCRIPTION OF THE PREFERRED EMBODIMENTS

Figure 1:
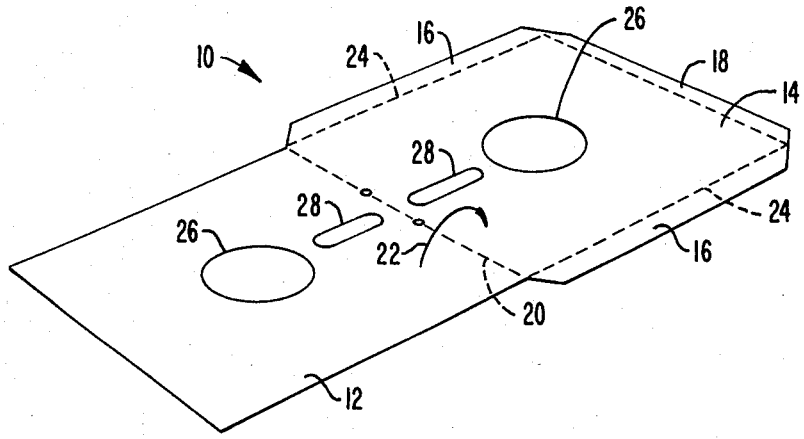
FIG. 1 is an isometric view of an envelope blank of the type being folded by the present invention.

While the present invention will be generally useful for folding any type of envelope or jacket starting with a substantially flat piece of material, it will find particular use in folding envelopes for floppy disks of the type used for storing information for computers, word processors, and other information systems. As illustrated in FIG. 1, such floppy disk envelope blanks 10 are generally precut to a desired profile suitable for folding into a floppy disk envelope. The blank 10 includes two faces 12 and 14, with face 14 having a pair of side flaps 16 and an end flap 18. The envelope is folded by making a first transverse fold along line 20 in the direction of arrow 22. This fold brings the faces 12 and 14 of the envelope together. After the transverse fold, side flaps 16 are folded inward along lines 24 to close the sides of the envelope. The side flaps 16 are sealed, typically by applying pressure sensitive glue before folding or by heat staking after folding, and the folded envelope 10 is ready for insertion of the disk. The method and apparatus of the present invention are directed at making the three folds just described as well as sealing the side flaps 16. The envelopes 10 will then be transferred to other commercially available equipment for insertion of the floppy disk and closure and sealing of the top flap 18.

The embodiment of the present invention which is illustrated is particularly designed to fold envelope blanks 10 which are precut to include spindle holes 26 and read/write holes 28. Envelope blanks are also available where the holes 26 and 28 have not been cut. The holes would then be stamped in the folded envelope jacket prior to insertion of the disk. The present invention could be suitably modified (as described below) to manipulate envelope blanks without such holes.

Figure 2:
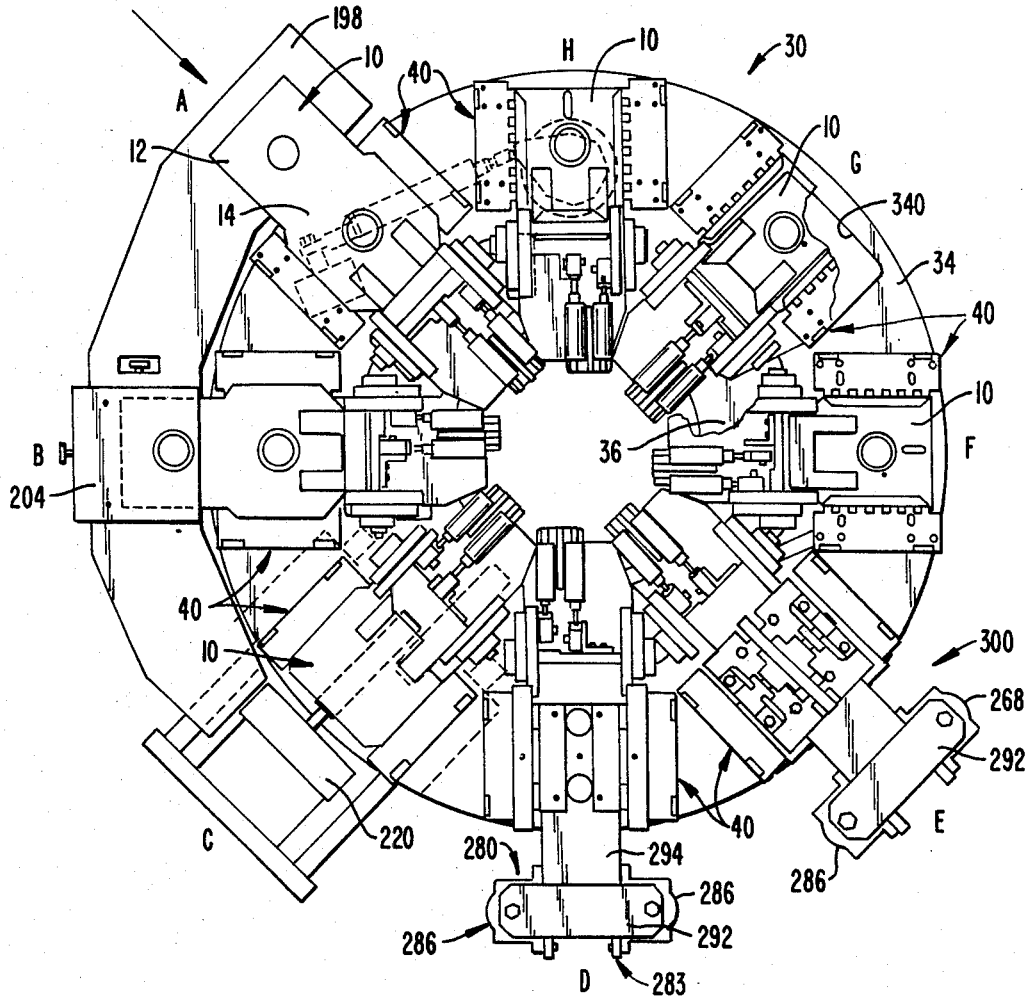
FIG. 2 is a top plan view of the envelope folding system of the present invention, with portions broken away.

Referring now to FIG. 2, a plan view of an envelope folding system 30 is illustrated. The folding system 30 comprises a floor mounted lower support frame (not illustrated) having a stationary top plate 34. A circular table 36 is rotatably mounted on the top plate 34, and a drive motor and cam drive assembly (not illustrated) are provided for incrementally rotating the circular table relative to the top plate. Typically, the motor and cam drive for rotating the table 36 will be a servo-controlled electric motor capable of rotating the table through a precise angle. Such drive systems are well known in the art and need not be described further.

A total of eight platform assemblies 40 are mounted on the rotatable circular table 36 so that they are able to rotate relative to the stationary top plate 34. The top plate 34 is also divided into eight areas or stations where certain stationary assemblies, as described in detail hereinafter, are mounted for performing particular operations on envelope blanks which are carried by the platform assemblies 40.

Platform Assemblies

Figure 3A:
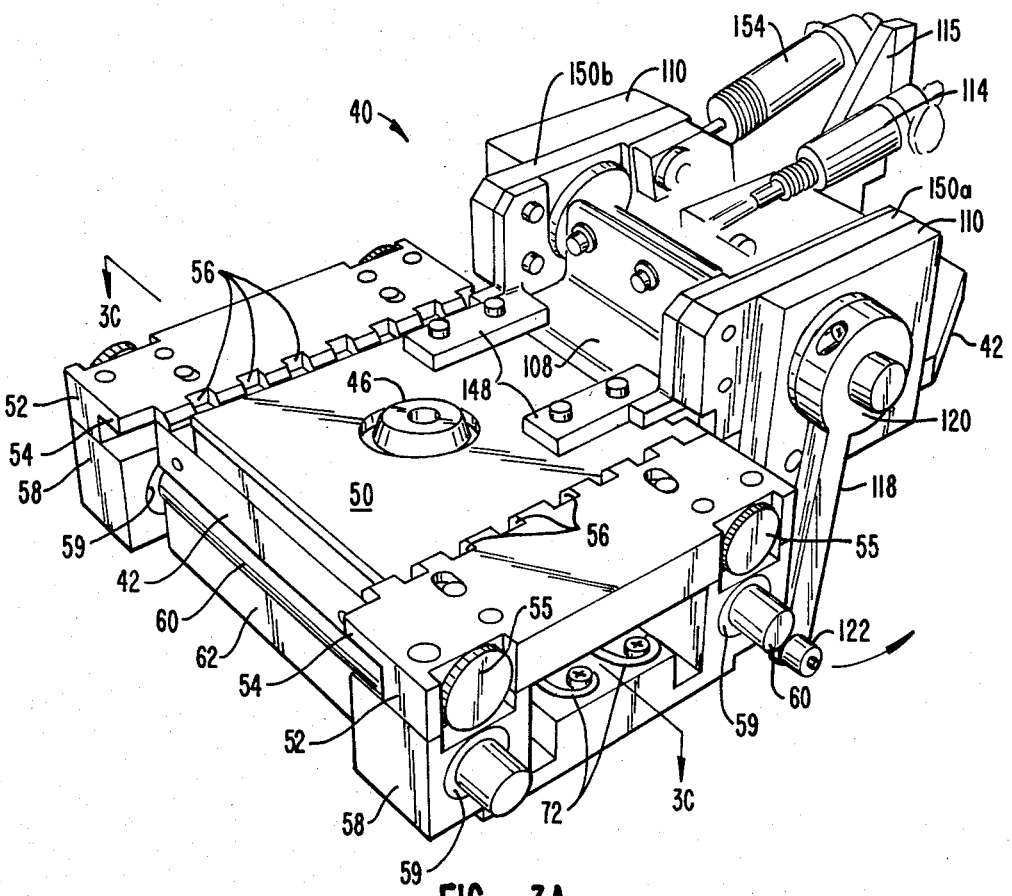
FIG. 3A is a perspective view of the platform assembly of the envelope folding system of the present invention.
Figure 3D:
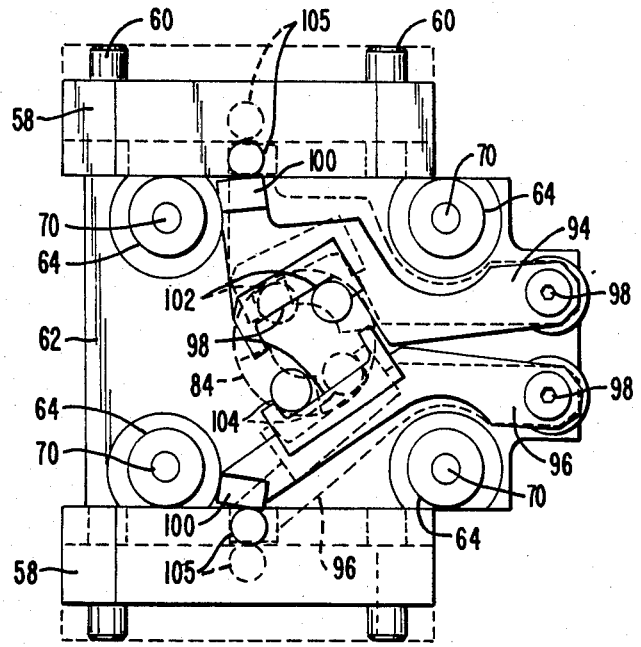
FIG. 3D is a bottom plan view of the platform assembly illustrating the mechanism for actuating the flap folding dies.
Figure 3B:
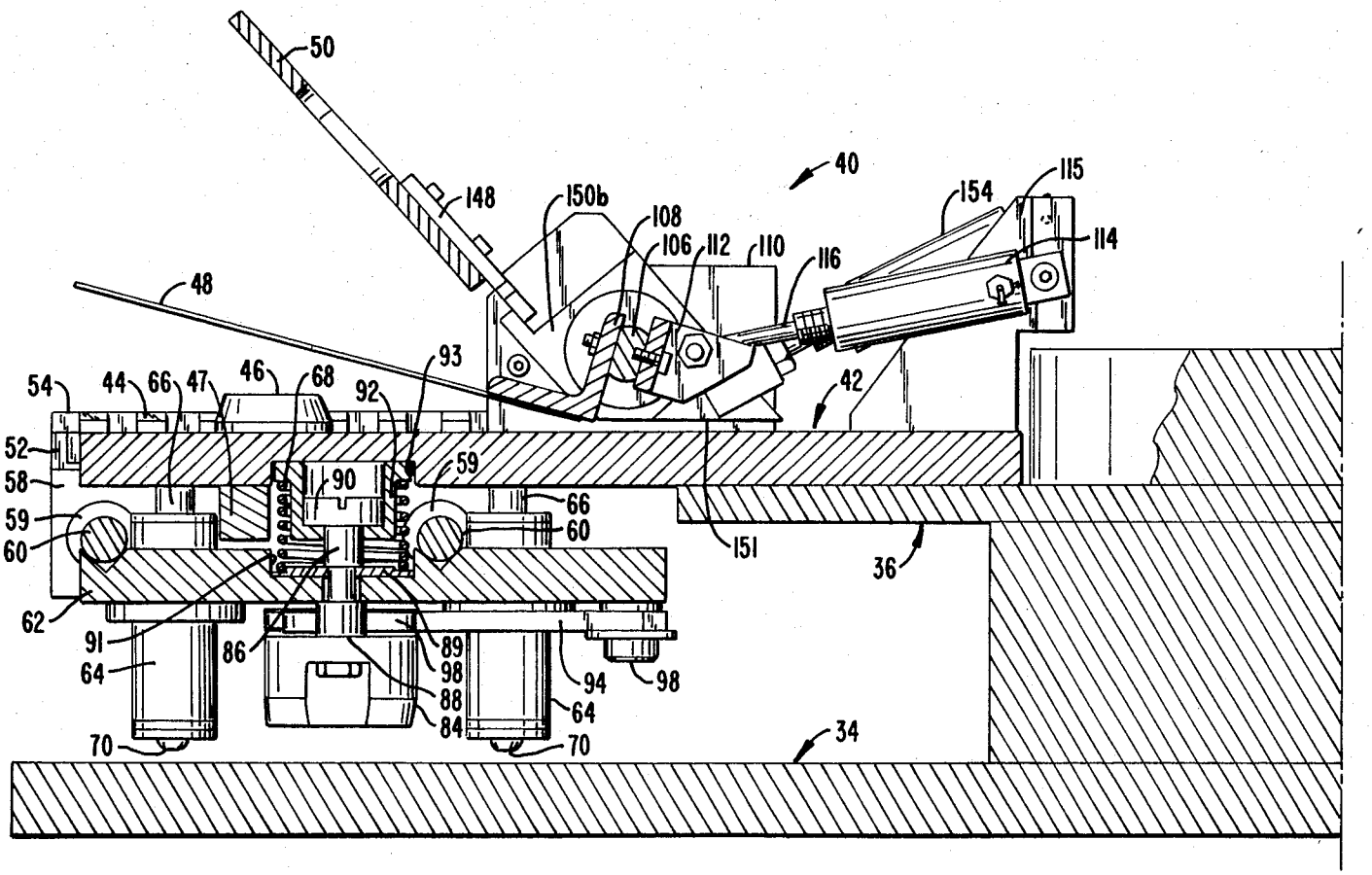
FIG. 3B is a side, sectional view of the platform assembly with the clamping member and mandrel shown in their raised positions.
Figure 3C:
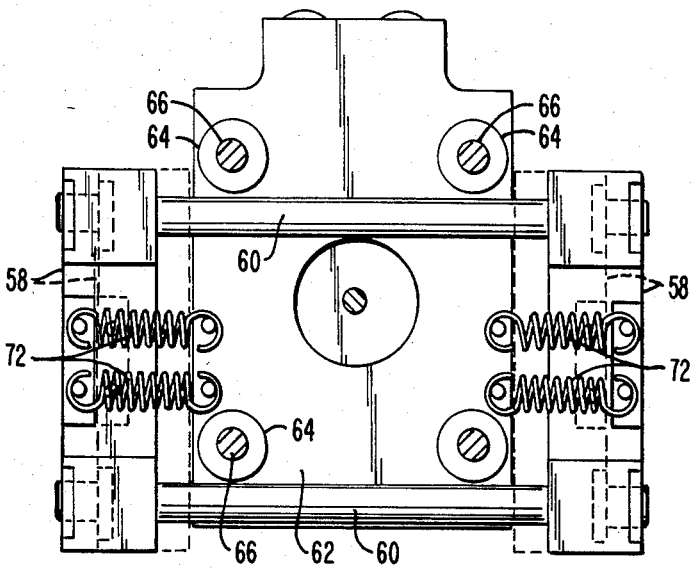
FIG. 3C is a top sectional view taken along lines 3C—3C of FIG. 3A.

Referring now to FIGS. 3A-3K, the construction of the platform assemblies 40 will be described in detail. Referring in particular to FIGS. 3A and 3B, platform assemblies 40 are constructed on an elongate base 42 which is secured at its rear end (to the right as viewed in FIG. 3B) to the circular table 36. At its forward end, the base 42 defines a flat support surface 44 upon which the envelope blanks are received. A registration plug 46 is located on the support surface 44 for positioning the envelope blanks. As will be described in detail below, the spindle holes 26 of the envelope blanks 10 (FIG. 1) are received over the registration plug 46 as the blanks are fed to the platform assemblies 40.

In order to accomodate envelope blanks which have not been stamped (and therefore do not include spindle holes), it is necessary to provide for outside registration. That is, barriers (not illustrated) must be formed on the support surface 44 to properly position the envelope blanks as they are fed onto the platform assemblies 40. The construction of such barriers is well within the skill in the art.

A heater block 47 (FIG. 3B) is mounted on the lower surface of base 42, generally beneath the area where the envelope blanks are supported. It has been found that heating of the lower face of the envelope blank 10 during the folding operation prevents bowing of the folded envelope jacket after it is removed from the folding system. A temperature in the range from about 105° F. to 115° F. has been found suitable, with the particular temperature depending on the material and thickness of the envelope blank and other factors.

The platform assemblies 40 include a number of movable elements which are used to manipulate the envelope blanks 10 when they are received thereon. Such movable elements include a mandrel 48 which holds the envelope blank 10 in place as the first transverse fold 20 (FIG. 1) is performed. A clamp member 50 secures the envelope blank 10 as the side folds 24 and heat sealing operations are carried out. Both the mandrel 48 and the clamp member 50 are shown in their raised positions in FIG. 3B, while they are shown in their lowered positions in FIG. 3A. The mechanisms for both raising and lowering the mandrel 48 and clamp 50 will be described below.

The platform assembly 40 also includes a pair of flap folding dies or clamps 52 which are actuated to fold the side flaps 16 of the envelope blank 10 and secure them during and after the heat stake operation. The flap clamps 52 include a flange 54 (best illustrated in FIGS. 3E–3G) which engages the side flaps 16 of the envelope blank 10. The flange 54 includes a plurality of apertures 56 which allow heat staking while the envelope is held in place by the flap clamps 52.

Flap clamps 52 are mounted on support blocks 58 having bearing members 59 which are slidably received on rods 60. The rods 60 are each secured to a vertically-reciprocatable plate 62 including four linear ball bearings 64 (illustrated best in FIG. 3B) depending vertically therefrom. The linear ball bearings 64 are received on four vertical posts 66 which project downward from the bottom of base 42. In this way, the plate 62 carrying the rods 60 is able to reciprocate upward and downward relative to the baseplate 42. Moreover, since the support blocks 58 are capable of horizontal movement along the rods 60, the flap clamps 52 are capable of both vertical movement and horizontal movement in order to fold the side flaps 16 of the envelope blank 10, as will be described in detail hereinafter.

A spring 68 extends between the bottom of baseplate 42 and the top of vertically-reciprocatable plate 62. The spring 68 is under compression and forces plate 62 downward relative to base 42. The upper end of spring 68 is received on the outer surface of die stop 92, which in turn is received in a recess 93 formed on the lower surface of base 42. The lower end of the spring is received on a reinforcment washer 89 received in a recess 91 formed on the top of plate 62.

Springs 72 (FIG. 3C) similarly govern the horizontal movement of support blocks 58 relative to plate 62. The springs 72 extend between the support blocks 58 and the vertically-reciprocatable plate 62 and are under extension at all times so that the support blocks are urged inward toward the plate.

Figure 3H:
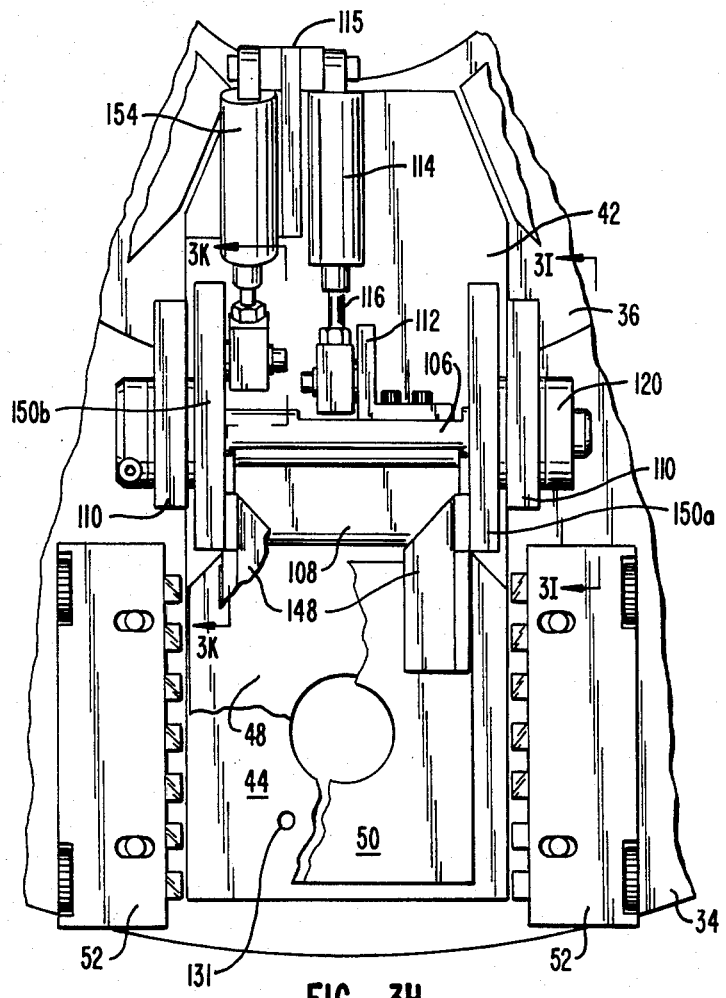
FIG. 3H is a top, plan view of the platform assembly with portions broken away and the flap folding clamps in their outward-extended positions.
Figure 3E:
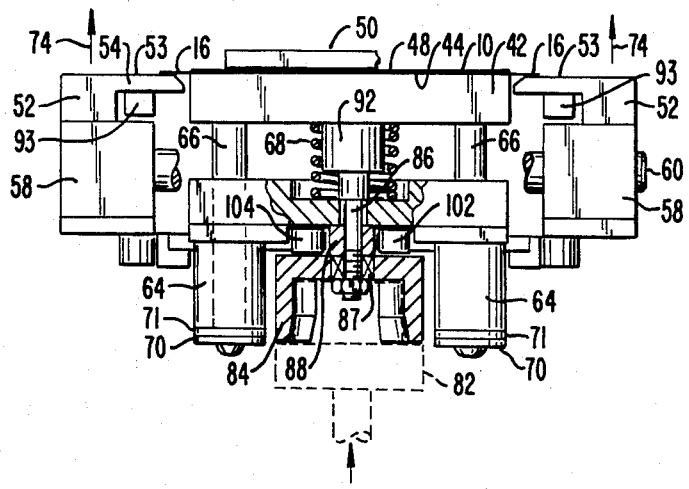
FIG. 3E is a front elevational view of the platform assembly of the present invention illustrating the flap folding dies in their lowered, outwardly-extended positions.
Figure 3F:
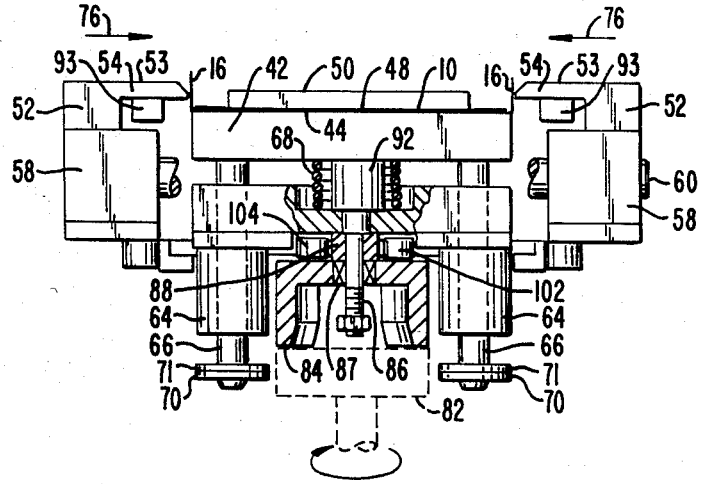
FIG. 3F is a front elevational view of the platform assembly illustrating the flap folding dies in their upward, fully-extended positions.
Figure 3G:
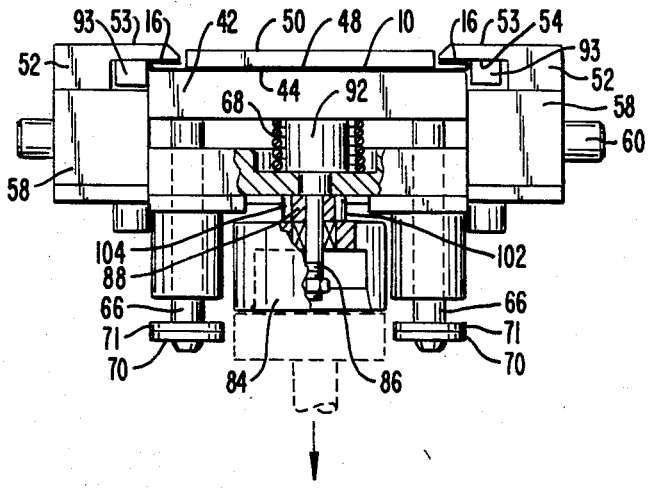
FIG. 3G is a front elevational view of the platform assembly illustrating the flap folding dies in their inward-retracted position, being clamped down on the side flaps of the envelope.

Referring now in particular to FIGS. 3D–3G, the mechanism for actuating the flap clamps 52 to fold side flaps 16 will be described. The necessary motion for making the folds is best illustrated in FIGS. 3E–3G. Initially, the upper surfaces 53 of flap clamps 52 are vertically aligned with the support surface 44 of base 42, as illustrated in FIG. 3E. The envelope 10 has been folded transversely (as described hereinafter) and is held in place by clamp 50. The flap clamps 52 initially move upward as indicated by arrows 74, causing the side flaps 16 to fold upward approximately 90° until they reach the configuration of FIG. 3F. The flap clamps 52 move upward until the lower surface of flange 54 is slightly above the envelope 10. At that point, the flap clamps 52 are moved inward (in the direction of arrows 76 in FIG. 3F) to complete the folding operation. Note that it is necessary to heat along the fold line 24 prior to making the fold. The mechanism responsible for providing the heat will be described hereinafter. After the flap clamps 52 are moved fully inward, force from spring 68 urges the flanges 54 against the side flaps 16 to hold the side flap firmly in place during the subsequent heat seal operation, as will be described hereinafter.

Flap clamps 52 are moved upward by an actuator mechanism 80 (FIGS. 4A–4B) which is mounted on the bottom of top plate 34. The actuator 80 includes a coupling 82 which can be reciprocated upward and downward and turned through an angle of approximately 90°. When it is desired to raise the flap clamps 52, the coupling 82 is raised to engage a mating coupling 84 (FIGS. 3B, 3E–3G) attached to a shaft 86. The coupling 84 is rotatably mounted on the shaft 86 on bearing 87 (FIGS. 3E and 3F). The shaft 86, in turn, secures the coupling 84 to vertically-reciprocatable plate 62 through a spacer 88. A cap 92 (FIG. 3B) at the upper end of shaft 86 is received in the die stop 92 and acts as a travel stop preventing the plate 62 from sliding off posts 66. End caps 70 also act to limit such downward travel and include resilient washers 71 on the upper surfaces to absorb shock.

The structure which has just been described allows the plate 62 to be raised by a force applied by coupling 82 onto the mating coupling 84. The plate 62 is returned to its lowered position by spring 68, unless the flange 54 of the flap clamps 52 is hooked over the edge of the support surface 44 of base 42 which will hold the plate 62 in its raised position.

Squaring bars 93 are mounted on the lower faces of flanges 54. The squaring bars 93 assure that the side flaps 16 of the envelope blanks 10 are squarely folded along lines defined by the edges of mandrel 48. As best illustrated in FIG. 36, the squaring bars 93 are pressed against the edges of the mandrel 48 to prevent uneven folding. The bars 93 will be adjustably mounted on the flanges 54 to allow for proper alignment.

Referring now in particular to FIG. 3D, the mechanism carried on platform assemblies 40 for horizontally actuating the flap clamps 52 will be described. A pair of levers 94 and 96 are pivotably mounted at one end on pins 98. A cam surface 98 is provided at the middle of each lever 94 and 96 and a hammer 100 is formed at the distal end thereof. The levers 94 and 96 are moved both inward and outward by a pair of rollers 102 and 104 mounted on top of the coupling 84. Rotation of the coupling member 84 is limited by travel of the rollers 102 and 104 within the closed ends of the cam surfaces 98. As shown in full line in FIG. 3D, the coupling member 84 is rotated fully clockwise, and the levers 94 and 96 are in their fully retracted configuration. By turning the coupling 84 in the counterclockwise direction, the levers 94 and 96 are forced outward to assume the positions shown in broken lines. Coupling 84 can be turned in either direction by the actuator mechanism 80, as described fully hereinafter.

Each support block 58 includes a drive roller 105 on its bottom surface. Each drive roller 105, in turn, is engaged by the hammer 100 on the respective lever 94 or 96. Thus, support blocks 58 may be simultaneously driven outward by counterclockwise rotation of the coupling member 84 and thereafter returned to their retracted positions by clockwise rotation. Because of the particular inclination of the cam surface 98 relative to the rollers 102, the levers 94 and 96 each achieve their maximum outward extension at a point intermediate the clockwise and counterclockwise travel limits of the coupling 84. Thus, the action of springs 72 (FIG. 3C) which urges support blocks 58 inward at all times, will lock the levers 94 and 96 in either the fully extended or fully retracted configurations, depending on which position the coupling 84 was last turned. Thus, once flap clamps 52 are actuated into their open or closed positions, they will retain these positions until intentionally actuated into the other position.

The mechanism for supporting and manipulating the mandrel 48 and clamp member 50 will now be described with particular reference to FIGS. 3B and 3H–3L. The mandrel 48 is mounted on axle 106 by a linking member 108. The mandrel 48, linking member 108 and axle 106 are rigidly attached to one another so that the mandrel will move when the axle is rotated. The axle 108, in turn, is rotatably mounted in a pair of upright supports 110 which are secured on either side of base 42. A bracket 112 is mounted on the axle 106 on the side opposite to the mandrel 48. The bracket 112 is attached to an air spring 114 through a rod 116, and the cylinder end of the air spring is attached to a fixed bracket 115 secured to the base 42 of the platform assembly 40. Thus, as the mandrel 48 is raised, the air spring 114 is compressed over the initial portion of its upward travel. As the mandrel reaches its half-raised position, however, the air spring is maximally compressed and thereafter relaxes as the mandrel reaches its fully raised position. In this way, the air spring 114 will hold the mandrel 48 open or closed, only requiring energy to move the mandrel between those two positions. The tension of air springs 114 on each platform assembly 40 is controlled by a common air pressure source, typically an air regulator (not shown) connected to a source of pressurized air. In this way, the tension on all of the air springs 114 can be adjusted simultaneously.

Figure 3I:
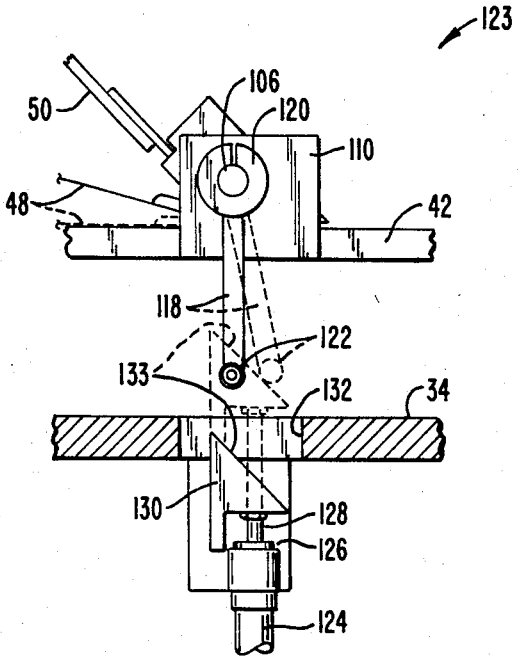
FIG. 3I is a detail view illustrating the mechanism for lowering the mandrel.
Figure 3J:
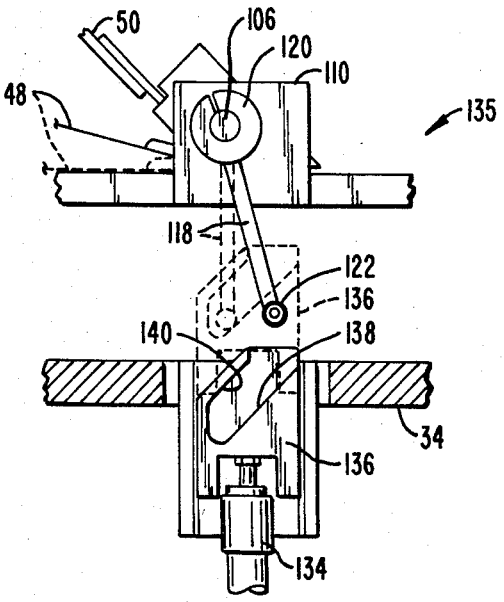
FIG. 3J is a detail view illustrating the mechanism for raising and lowering the mandrel at the alignment station.
Figure 3L:
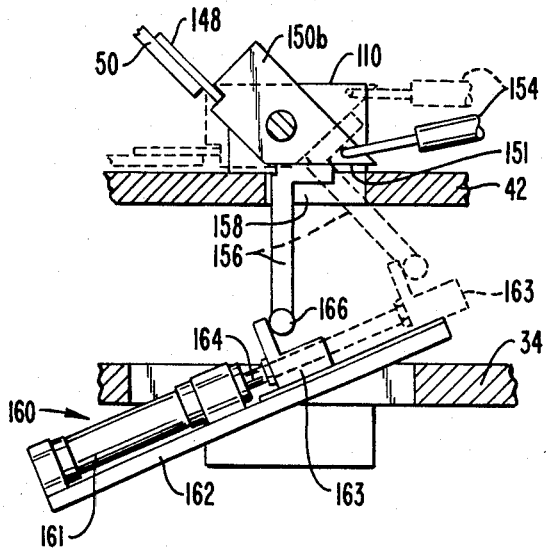
FIG. 3L is a detail view illustrating the mechanism for lowering the clamp member at the first (transverse) folding station.
Figure 3K:
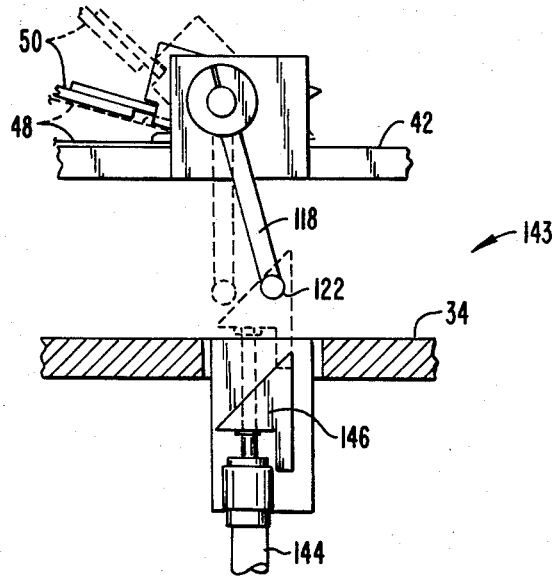
FIG. 3K is a detail view illustrating the mechanism for raising the mandrel and clamp member at the outlet station.

A lever arm 118 (FIGS. 3A and 3I–3K) is attached to axle 106 by a clamp collar 120. A roller 122 at the lower end of the lever 118 can be actuated to open and close the mandrel 48, as illustrated in FIGS. 3I, 3J and 3L.

To close the mandrel 48, a mandrel lowering assembly 123 is mounted on top plate 34 at the feed station, as described hereinafter. The assembly 123 is mounted on a bracket 126 and includes an air cylinder 124 and a cylinder rod 128 having a wedge 130 at its distal end. The assembly 123 is mounted so that the wedge penetrates an opening 132 formed in the plate 34. As it travels upward, an inclined surface 133 defined by the wedge 34 engages the roller 122, rotating the lever 118 in a counterclockwise direction to close the mandrel 48, as illustrated in broken lines. The air cylinder 124 then retracts and the mandrel is held down by the air spring 114. A pair of permanent magnets 131 (only one of which is illustrated in FIG. 3H) are mounted on support surface 44 and ensure that the mandrel 50 is held down firmly on top of envelope blank 10.

At the alignment station, described more fully hereinafter, it is necessary to raise and lower the mandrel 48 in order to release the envelope blank while it is being aligned. A mandrel raising and lowering assembly 135 (FIG. 3J) is provided at the alignment station for this purpose. The assembly 135 includes air cylinder 134 which is identical to the air cylinder 124, except that the wedge 130 is replaced by a camming block 136. The camming block 136 includes a lower camming surface 138 and an upper camming surface 140. As the camming block 136 is raised, the lower camming surface 138 engages the roller 122, rotating the lever arm 118 clockwise. Once lever 118 reaches the position shown in broken lines, and the mandrel 48 has been fully raised and the envelope blank can be aligned. Once alignment has been completed, the camming block 136 is lowered to close the mandrel 48. Upper surface 140 engages the roller 122, rotating the lever 118 in the counterclockwise direction. When the camming block 136 is fully lowered, the lever 118 is rotated to the position shown in full line (FIG. 3J) and the mandrel 48 is again fully closed.

Before removing the folded and sealed envelope from the folding apparatus, it is necessary to raise both the mandrel 48 and the clamp member 50. To accomplish this, mandrel raising assembly 143 (FIG. 3K) is provided at the discharge station, as will be described in detail hereinafter. The assembly 143 includes an air cylinder 144 and a wedge 146, which wedge is identical to the wedge 130 included in air cylinder assembly 123. The wedge 146, however, faces the opposite direction so that as the wedge 146 is raised, it will engage roller 122 and cause lever 118 to rotate in the clockwise direction. This action causes the mandrel 48 to rise to its fully raised position (as shown in broken line in FIG. 3K). The action of raising the mandrel 48 will also raise the clamp member 50. Thus, no separate mechanism is provided for raising the clamp member 50.

The mounting of the clamp member 50 will now be described. Clamp member 50 is attached at its rear end (to the right in FIG. 3B) to a pair of brackets 148, which in turn are secured to blocks 150. Blocks 150 are both received on axle 106 and capable of independent rotation thereon. Thus, axle 106 can be rotated to raise and lower mandrel 48 while clamp member 50 remains in its fully raised position. Also, clamp member 50 can be lowered after mandrel 48 has been lowered. Blocks 150 terminate at their rear end in a tapered surface 151 which provides sufficient clearance for the blocks to rotate about 45° between the fully lowered and fully raised positions.

An air spring 154 is connected at one end to the tapered end of the rightward block **150*b* (as viewed in FIG. 3H) and at the other end to support bracket 115**.

Upward rotation of the clamp member 50 is limited by the travel of air spring 154. As explained earlier in reference to air spring 114, air spring 154 is oriented so that it is maximally compressed when the clamp member 50 is positioned between its fully raised and fully lowered positions. Thus, the air spring 154 will hold the clamp member 50 in either the fully opened or fully closed position. The clamp member 50 as shifted between the two positions will now be described.

Referring in particular to FIG. 3L, block **150*b* includes an integral lever arm 156 which extends through an opening 158 in the base 42. A clamp actuator assembly 160 is provided at the first traverse folding station in order to close the clamp member 50. The air cylinder assembly 160 includes an air cylinder 161 mounted on an inclined plate 162, which in turn is secured to top plate 34. Angle member 163 on cylinder rod 164 engages roller 166 at the distal end of lever 156 when the air cylinder 161 is actuated. This causes the block 150*b* to rotate in the counterclockwise direction, lowering the clamp member 50 onto mandrel 48. The clamp 50 remains in its lowered position until it is raised when the mandrel 48 is elevated by air cylinder assembly 143**, as described previously.

Actuator Mechanism

Figure 4A:
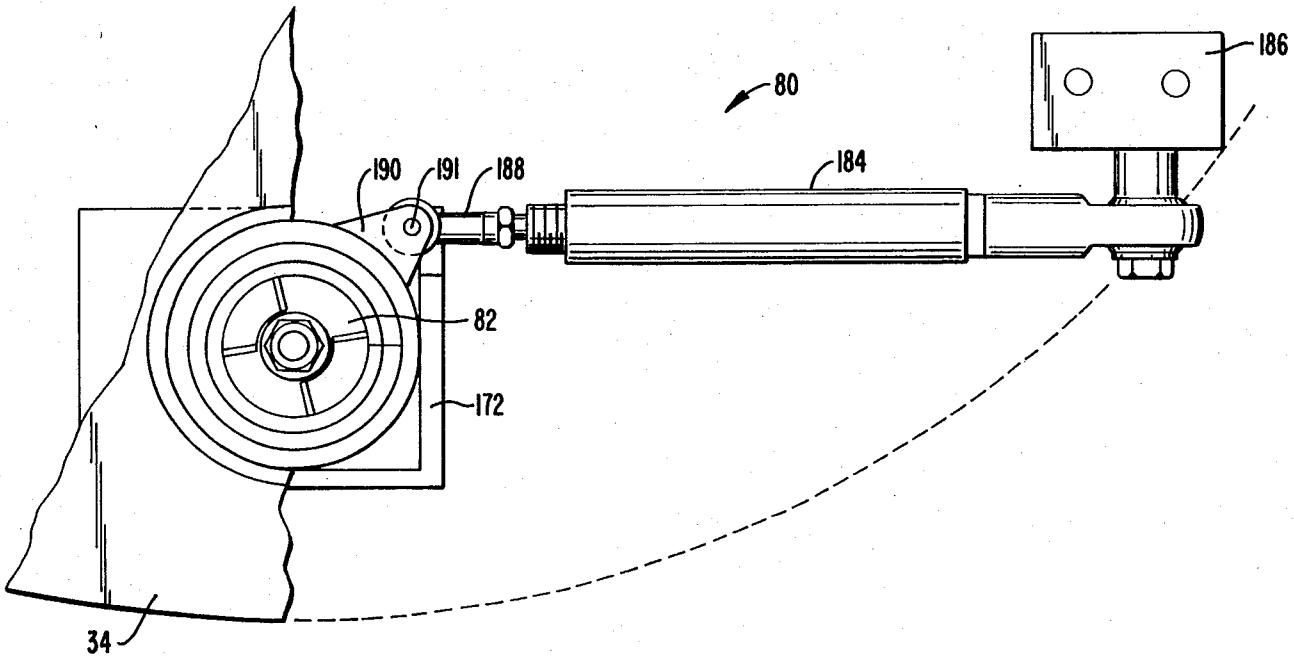
FIGS. 4A and 4B are detail views illustrating the mechanism for actuating the flap folding dies, located at the second (flap) folding station and outlet station.
Figure 4B:
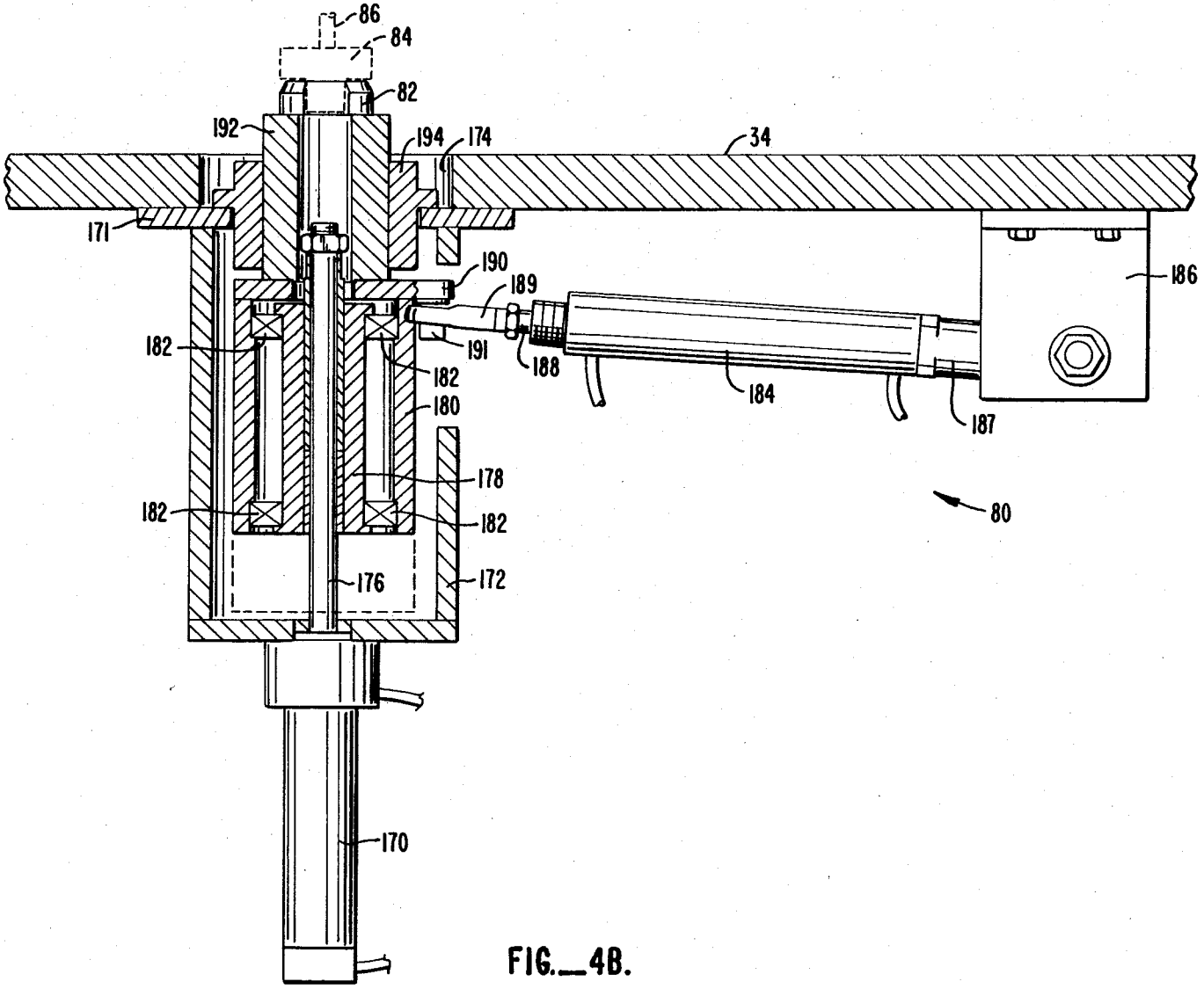

Referring now to FIGS. 4A and 4B, the actuator mechanism 80 will be described in detail. As explained previously, the actuator mechanism 80 operates the flap clamps 52 on the platform assemblies 40. There are two actuator mechanisms 80 included in the envelope folding system 30, one located at the second (side flap) folding station and the other located at the discharge station. The actuator 80 at the second folding station drives the flap clamps 52 upward and inward (as illustrated in FIGS. 3E through 3G) while the actuator 80 at the discharge station moves the clamps outward and downward to release the folded envelope.

The actuator mechanism 80 comprises a double-acting air cylinder 170 (FIG. 4B) mounted on a housing 172 attached to the lower surface of top plate 34 on a mounting plate 171. The housing 172 is aligned with an opening 174 in top plate 34 which, in turn, is vertically aligned with the position of coupling member 84 when a platform 40 is positioned at the second folding station or discharge station.

Rod 176 of air cylinder 170 projects upward into housing 172. A spool 178 is fixedly mounted on the rod 176, and a cylindrical housing 180 is rotatably mounted around the spool 178 on bearings 182. Thus, the cylindrical housing 180 is able to reciprocate upward and downward upon actuation of air cylinder 170 and is rotatable relative to the rod 176.

Rotation of the cylindrical housing 180 is controlled by a second double-acting air cylinder 184 having its cylinder end attached to a bracket 186 on plate 34 by a universal connector 187. Rod 188 of cylinder 184, in turn, is attached to an anchor 190 (best illustrated in FIG. 4A) formed on the outside of cylindrical housing 180 by a second universal connector 189. Thus, as rod 188 is extended, cylindrical housing 180 is caused to rotate in a counterclockwise direction, as illustrated in FIG. 4A. The universal connectors 187 and 189 allow both rotation and translation of the cylindrical housing 180 without binding.

Actuator coupling 82 includes a shank portion 192 which is secured to the top of cylindrical housing 180. The shank 192 is rotatably received in a bearing member 194 which is fixedly secured to plate 34 through mounting plate 171. Thus, the coupling member 82 can be both raised and rotated by the action of cylinders 170 and 184, respectively.

As illustrated in FIG. 4B, the coupling member 82 is in its fully raised position where it engages the mating coupling member 84 on the platform assembly 40. As described previously, raising of the coupling member 82 at the second folding station first causes the coupling member 84 to rise, lifting the flap clamps 52. Thereafter, air cylinder 184 is actuated to turn the coupling member 82 in the counterclockwise direction (as illustrated in FIG. 4A), which closes the flap clamps 52 inward, folding flaps 16 on the envelope blank 10. Thereafter, coupling member 82 is lowered and rotated back in the clockwise direction in preparation for manipulating the next platform assembly 40.

At the discharge station, the operation of actuator 80 is just the opposite. The coupling member 82 is raised to engage coupling member 84, the latter remaining in the raised configuration from the previous manipulation at the second folding station. The coupling member 82 is then rotated in the clockwise direction (as viewed in FIG. 4A) causing the flap clamps 52 to move outward. The coupling member 82 is then lowered, allowing the flap clamps to move downward under the influence of spring 68 (FIG. 3B).

Feed Station

The feed station, illustrated at location A on FIG. 2, is an unobstructed position on the folding machine where individual envelope blanks 10 can be fed onto the work platforms 40. A mantle 198 is provided along the periphery of the envelope folding system 30 to support face 12 of the envelope blank 10, while face 14 is received on support surface 44 of base 42 of the platform assembly 40. Mantle 198 extends from station A past alignment station B and terminates at the first folding station C.

Usually, automatic means for singulating the envelope blanks 10 and feeding them to the work platforms 40 will be provided. Such automatic feeding mechanisms do not comprise part of the present invention and are not illustrated herein.

Alignment Station

Figure 5B:
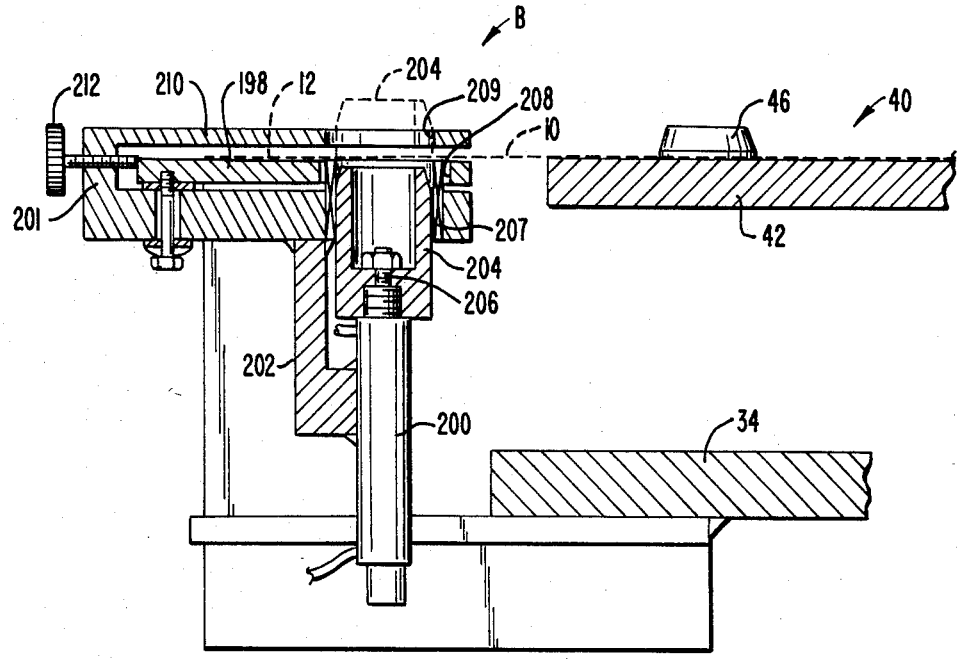
FIG. 5B is a side elevational view illustrating the alignment station and taken along lines 5B—5B of FIG. 5A.
Figure 5A:
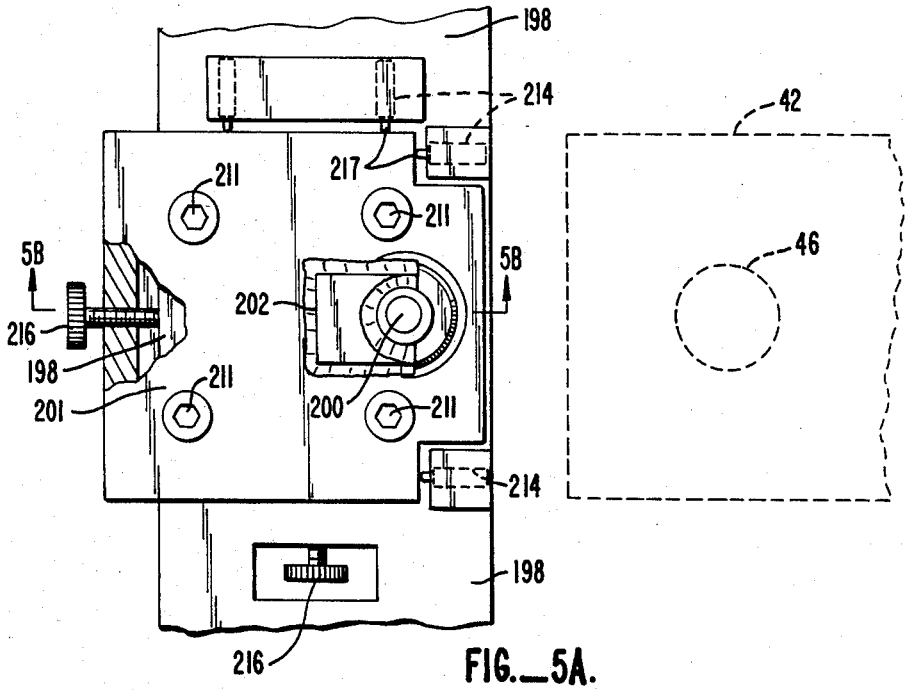
FIG. 5A is a bottom plan view illustrating the alignment station with portions broken away.

The alignment station B is located on the folding machine at a position 45° in the counterclockwise direction (as viewed in FIG. 2) from the feed station A. Referring in particular to FIGS. 5A and 5B, the alignment station B comprises a double acting air cylinder 200 which is suspended from an alignment enclosure 201 by a bracket 202. The air cylinder 200 carries an alignment plug 204 on rod 206, and the alignment plug can be vertically reciprocated in a sleeve bearing 207. The sleeve bearing 207 is received in hole 208 in mantle 198, and a hole 209 in an upper plate 210 of the enclosure 201 allows the alignment plug to travel upward to the position illustrated in broken lines in FIG. 5B. The diameter of hole 208 is slightly greater than the outside diameter of bearing 207. Thus, by adjusting the position of the alignment enclosure 201 (as will be described below), alignment plug 204 can be positioned to properly align an envelope blank 10 by simply penetrating spindle hole 26.

Figure 5C:
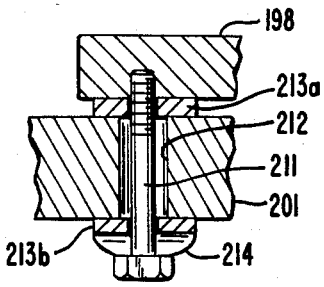
FIG. 5C is a detail view illustrating the mounting of the alignment enclosure on the mantle.

Alignment enclosure 201 is mounted on mantle 198 by four mounting screws 211. The screws 211 pass through an over-sized hole 212 in enclosure 201 and are threadably received in the bottom of mantle 198 (see FIG. 5C for detailed view). A first spacer washer 213*a* is inserted between the mantle 198 and enclosure 201 to allow the enclosure to slide relative to the mantle. A second washer 213*b* holds a spring washer 214 against the screw head 215. In this way, the screws 211 can be slightly loosened to allow proper vertical alignment of plug 204 and thereafter tightened to hold the enclosure firmly in place.

Vertical alignment of plug 204 is accomplished by horizontally positioning the enclosure 201 with opposed sets of thumb screws 216 and spring-loaded pins 217. The spring-loaded pins 217 are mounted in blocks 218 depending from the bottom of mantle 198, while the thumb screws 216 are rotatably secured in the mantle and press against the edges of the enclosure opposite the pins 217. Thus, the enclosure 217 can be translated along either horizontal axis by adjustment of the proper thumb screw 216 when mounting screws 211 are loosened.

First Folding Station

Figure 6:
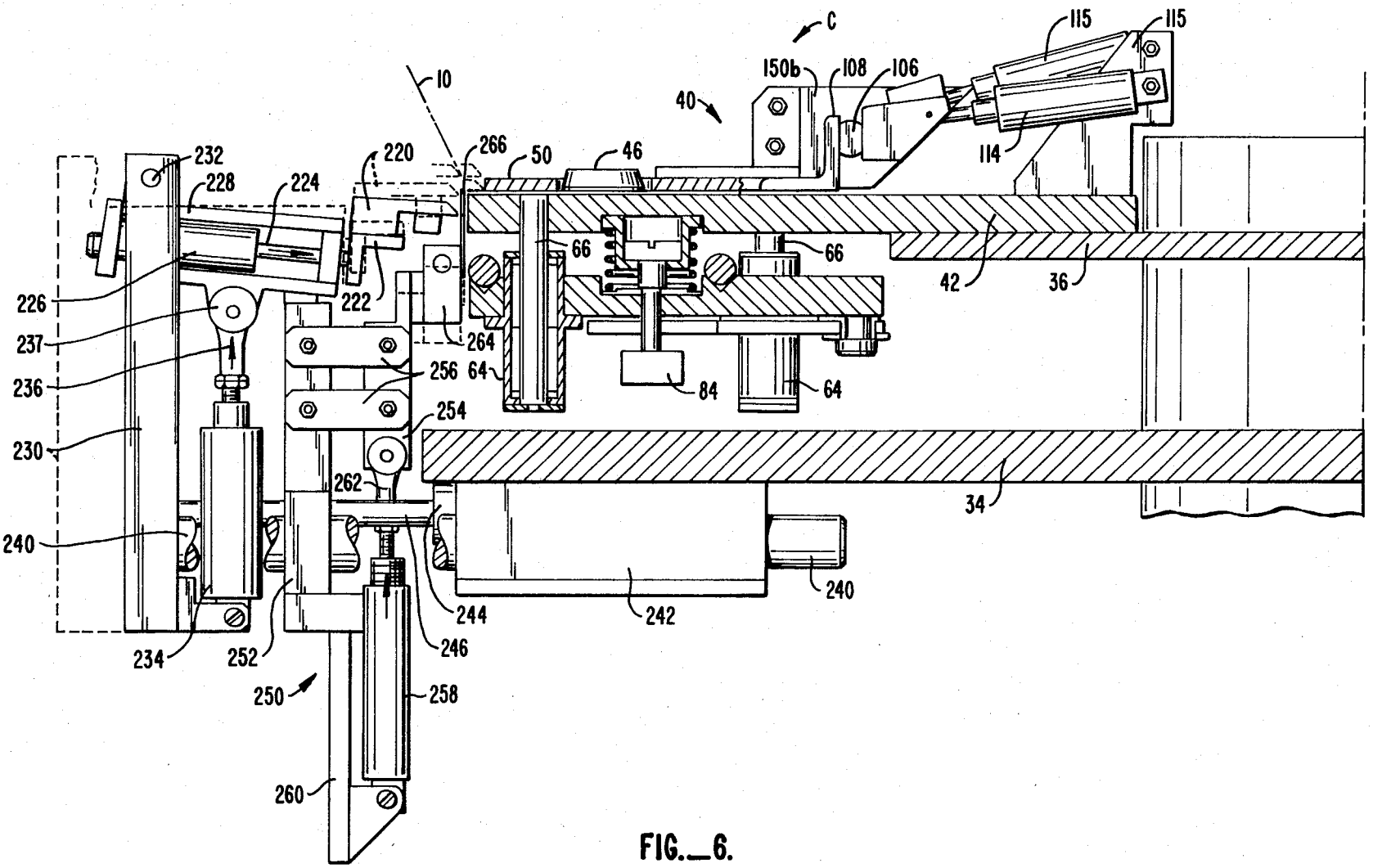
FIG. 6 is a side elevational view illustrating an envelope blank carried by a platform assembly present at the first folding station.

Referring now in particular to FIG. 6, the first (transverse) folding station C will be described in detail. The first folding station includes a folding bar 220 which is mounted on a bracket 222 on rod 224 of air cylinder 226. Reciprocation of air cylinder 226 causes the folding bar 220 to move in a forward direction (to the right in FIG. 5), which effects the first transverse fold 20 in the envelope 10.

The air cylinder 226 is mounted in cage 228 which, in turn, is pivotally mounted on an upright support frame 230. The cage 228 pivots on pin 232, allowing the cage to move between a lowered position illustrated in full line and a raised position illustrated in broken line. By raising the cage 228, which in turn raises the folding bar 220, the face 12 is folded upward to initiate the first folding operation as will be described hereinafter.

Cage 228 is raised and lowered by double acting air cylinder 234 which is mounted at the bottom of upright support frame 230. Rod 236 of air cylinder 234 terminates in a spherical rod end and is attached to anchor 237 formed on the bottom of cage 228.

The support frame 230 is mounted on a pair of rods 240 which are slidably received in bearings 242 mounted on the underside of plate 34. The frame 230 can be moved back and forth between the positions shown in full line and broken line by a second air cylinder 244. The second air cylinder 244 is also mounted on the underside of plate 34 and includes rod 246 which is attached at its distal end to the frame 230. Thus, reciprocation of air cylinder 244 will move support frame 230 in and out. The support frame 230 is moved to its outermost position (broken line) in order to allow clearance for the incoming assembly platform 40.

In addition to the mounting assembly for the folding bar 220, a heater blade assembly 250 is also mounted on rods 240. The heater blade assembly 250 includes a vertical frame 252 which is fixedly mounted on rods 240. A mounting block 254 is attached to the upper end of frame 252 by a pair of parallel arms 256. The arms 256 are pivotally attached to both the block 254 and support frame 252 to form a parallelogram support system. A double acting air cylinder 258 is mounted on a bracket 260 attached to the lower end of frame 252. Rod 262 of cylinder 258 terminates in a spherical rod end and is secured to the lower end of block 254 to allow vertical reciprocation of the block. A heated block 264 is attached to the upper end of the mounting block 254 and includes a blade 266 projecting upwardly therefrom. The air cylinder 258 is thus able to raise the heater blade upward into contact with the envelope blank 10 which is brought into the first folding station C on platform assembly 40.

The detailed operation of the first folding station will be described in detail hereinafter in reference to FIGS. 9F–9H.

Second Folding Station

The second (side flap) folding station for folding the flaps 16 of blanks 10 inward is illustrated at position D on FIG. 2. As is described previously, an actuator mechanism 80 will be mounted at location D in order to operate the flap folding clamps 52 on the platform assembly 40. Prior to folding the flaps 16, however, it is necessary to heat the fold lines 24 with a pair of heater blade blades. An assembly 280 for manipulating the heater blade blades 282 is illustrated in detail in FIGS. 7A and 7B.

The knife blade assembly 280 is mounted on a reciprocatable assembly 283 which includes a pair of upright support members 284 which are secured to the plate 34. An air cylinder 286 is mounted on a plate 287 spanning the upright supports 284, and includes a rod 288 having support bracket 290 at its distal end. The support bracket 290, in turn, is attached to a support plate 292. A single cantilever support plate 294 extends inward from the support plate 292, extending over the plate 234.

The heated blades 282 are mounted on a self-adjusting mounting assembly 295 supported on the top of cantilever support plate 294. The assembly 295 comprises a rod support block 296 having a pair of horizontal rods 297 fixedly mounted therein. One blade bracket 298 is mounted on rods 297 on each side of block 296. Bearings 299 are employed for mounting the brackets 298 to allow free movement. Springs 285 are provided to urge the blocks 298 in the outward direction. Alignment wedges 281 depend from the bottom of blocks 298 and include a chamfered surface 281*a* disposed in the outward direction. By providing a mating alignment wedge 279 on top of each flap folding die 52, the positions of the blocks 298 relative to the platform assembly 40 can be accurately controlled even when the platform assembly is slightly out of position.

By accurately positioning the blocks 298, blades 282 which are supported on the blocks will be aligned to heat along the desired fold lines 24. The blades 282 are mounted on heater blocks 278 by spacers 277. The heater blocks 278 are electrically heated to a desired temperature, and heat is transferred to the blades 282. Spacers 277 are preferably formed from a heater insulating material to avoid unnecessary heat loss.

Figure 7A:
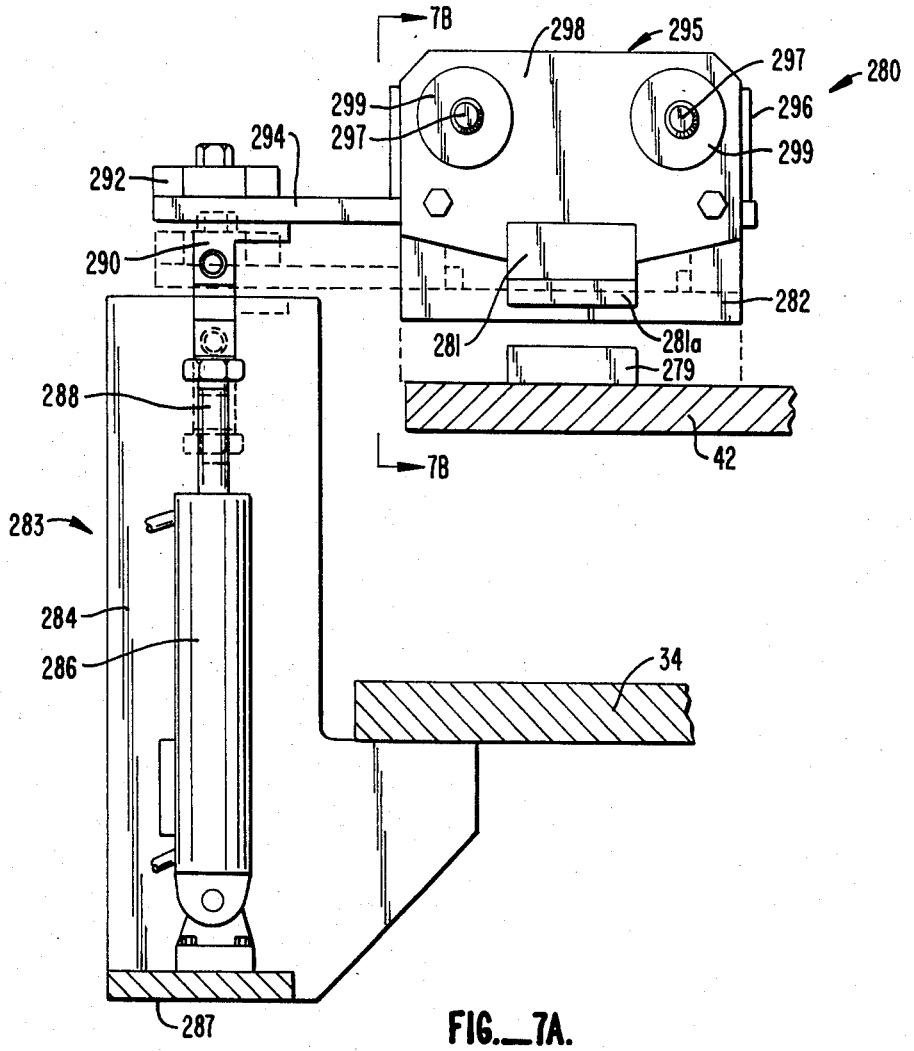
FIG. 7A is a side elevational view of the heater blade assembly present at the second folding station illustrated in section.
Figure 7B:
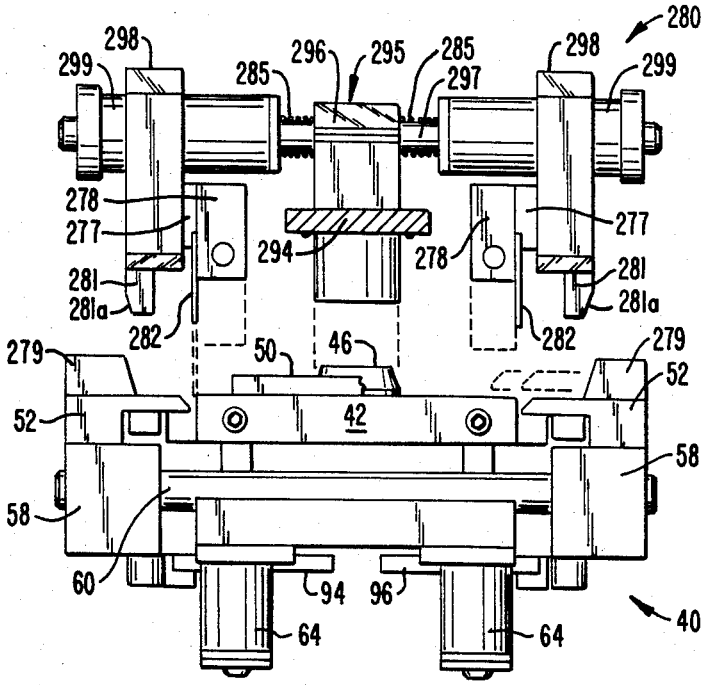
FIG. 7B is a front sectional view of the assembly taken along lines 7B—7B of FIG. 7A.

Using the assembly just described, air cylinder 286 can be used to reciprocate heated blade 282 between a raised position (shown in full line in FIG. 7A) and a lowered position (shown in broken line in FIGS. 7A and 7B). In the lowered position, the heated blades 282 will contact the envelope blanks carried by platform assemblies 40 to heat the blanks very accurately along fold lines 24 (FIG. 1). It has been found that accurate heating along the fold lines assures that the desired outside dimensional tolerances are met.

Heat Stake Assembly

Figure 8B:
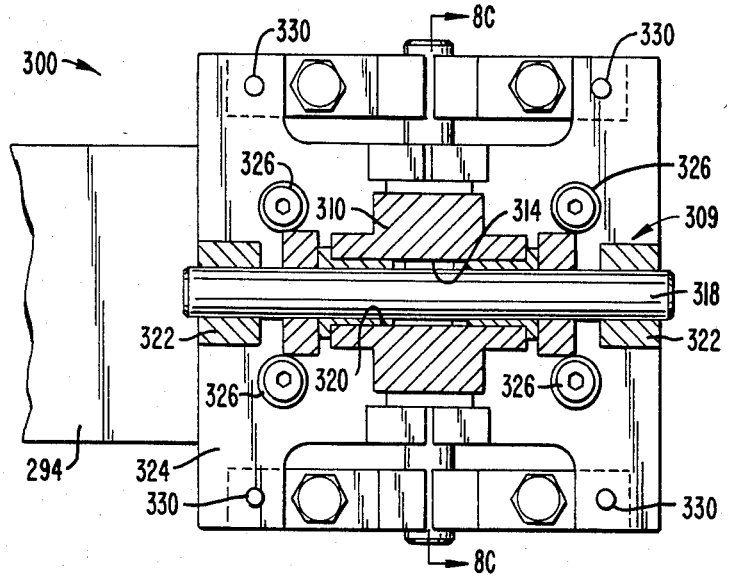
FIG. 8B is a top sectional view taken along lines 8B—8B of FIG. 8A.
Figure 8A:
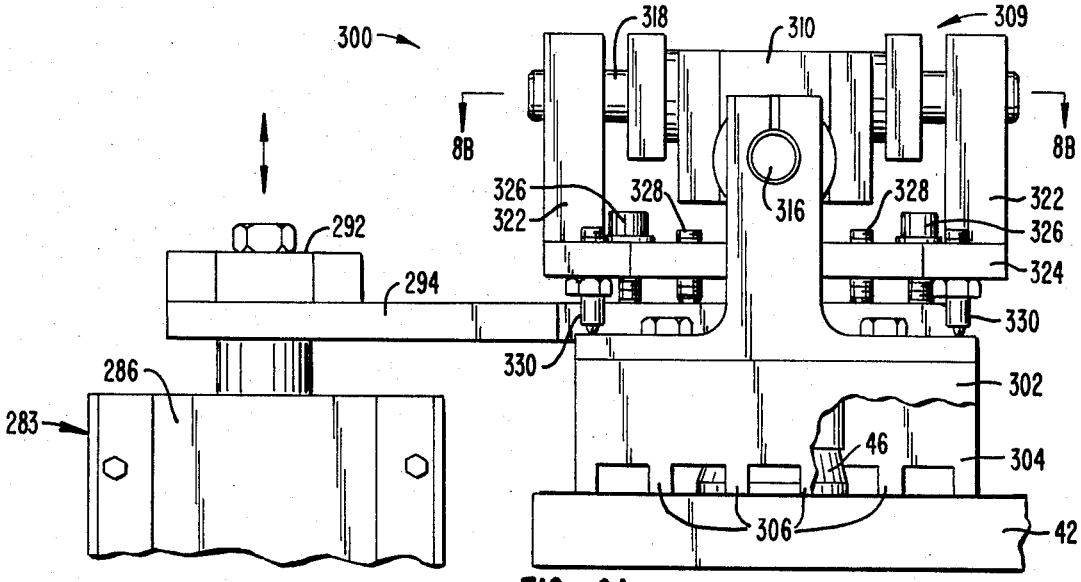
FIG. 8A is a side elevational view of the heat stake assembly located at the heat stake station.
Figure 8C:
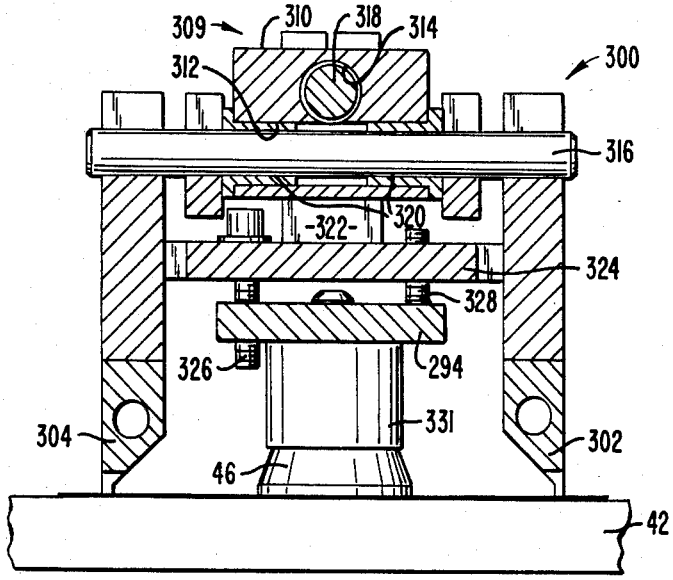
FIG. 8C is a front, sectional view taken along lines 8C—8C of FIG. 8B.

The heat stake assembly 300 is located at position E on FIG. 2, and is illustrated in detail in FIGS. 8A–8C. The heat stake assembly 300 is reciprocatably mounted on a reciprocable assembly 283 (FIG. 8A) which is identical to the assembly 283 described for the knife blade assembly 280. The cantilever member 294 extends inward over the base table 34 so that individual platform assemblies 40 are sequentially received thereunder.

Essentially, the heat stake assembly 300 comprises a pair of heat stake blades 302 and 304, each including a preselected number of heat stakes 306 which are located to interdigitate with the gaps 56 in the flap clamps 52 (FIG. 3A). The purpose of the heat stake assembly 300 is to raise and lower the heat stakes 302 and 304 at the proper time to seal the flaps 16 on the envelope blank 10.

The heat stake assembly 300 is provided with an adjustable suspension assembly 309 which allows the position of the heat stakes 306 to be adjusted around both horizontal axes. An axle block 310 includes first and second orthogonally opposed cylindrical passages 312 and 314 which receive suspension rods 316 and 318, respectively. The rods 316 and 318 are mounted in bearings 320 to assure their free rotation.

The axle block 310 is suspended on rod 318 between a pair of support posts 322. The support posts 322 are mounted on a plate 324 which in turn is secured by four set screws 326 to the cantilever beam 294. In addition, four adjustment screws 328 are provided to allow positioning of the support plate 324 relative to the cantilever beam 294. As described thus far, it is apparent that the axle block 310 is capable of rotation about a fixed axis relative to the cantilever beam 294 which is defined by rod 318.

Heat stake blades 302 and 304 are rotatably suspended from suspension rod 316. The suspension assembly 309 thus allows the position of the heat stake blades 302 and 304 to be adjusted about both axes defined by rods 316 and 318. Four spring plungers 330 are provided to allow self-adjustment as the heat stakes 306 are lowered. It is important that the heat stakes 302 and 304 be properly positioned so that the individual heat stakes 306 evenly contact the envelope 10 during the heat stake operation. Uneven contact will cause weak seal strength and uneven appearance.

A preload spacer 331 is provided on the bottom of the cantilever beam 294 to assure proper contact between the heat stake mechanism 300 and the base 42 of the platform assemblies 40. The heat stake assembly is lowered until spacer 331 contacts the chamfered surface of the registration plug 46, which contact acts as a stop.

Method of Operation

The method of operation of the envelope folding apparatus 30 of the present invention will now be described in detail with reference to FIGS. 9A–9M. The following description will follow one particular platform assembly **40*a*** as it travels from the feed station A to the discharge station H. It should be born in mind, however, that operations at five other operative stations of the apparatus will be occurring simultaneously.

Figure 9A:
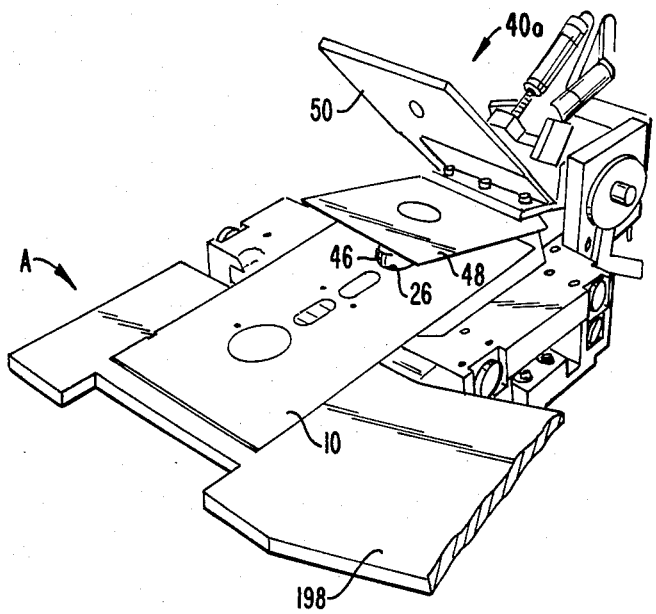
FIGS. 9A-9M are perspective views of the platform assembly as it is advanced to the various stationary assemblies, illustrating the sequential folding operations performed on the envelope blanks.
Figure 9B:
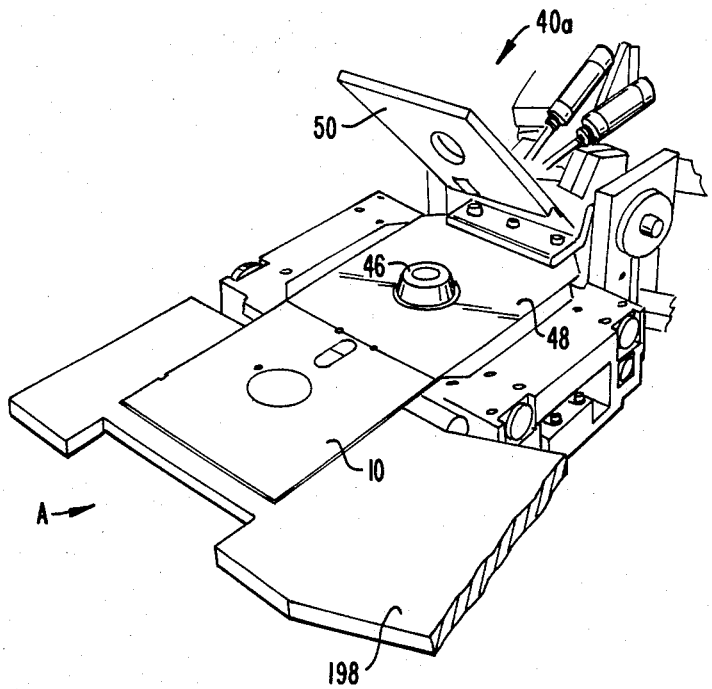

As illustrated in FIG. 9A, as platform assembly **40*a* enters the feed station A, both clamp member 50 and mandrel 48 are in their fully raised positions. After the platform assembly comes to a rest at feed station A, an individual envelope blank 10 is fed into position so that the spindle hole 26 is received over the spindle 46 on the assembly 40*a*. The mechanism for singulating and feeding the envelope blanks 10** does not form part of the present invention.

Figure 9C:
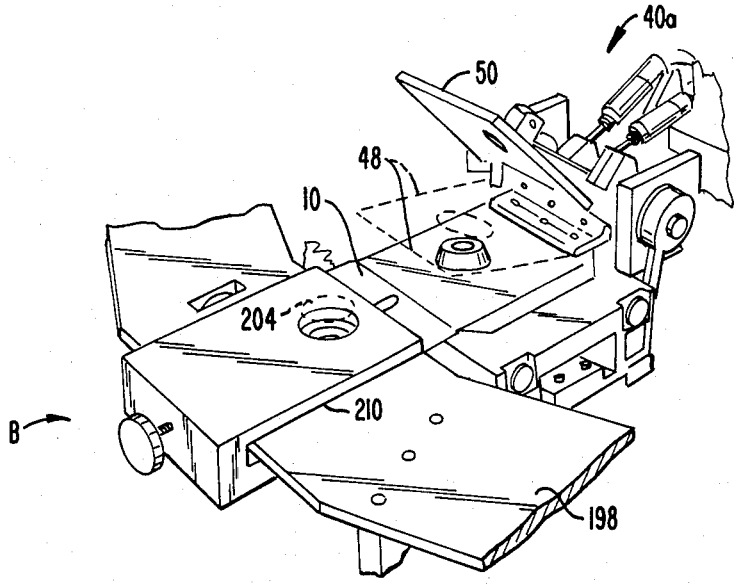
Figure 9D:
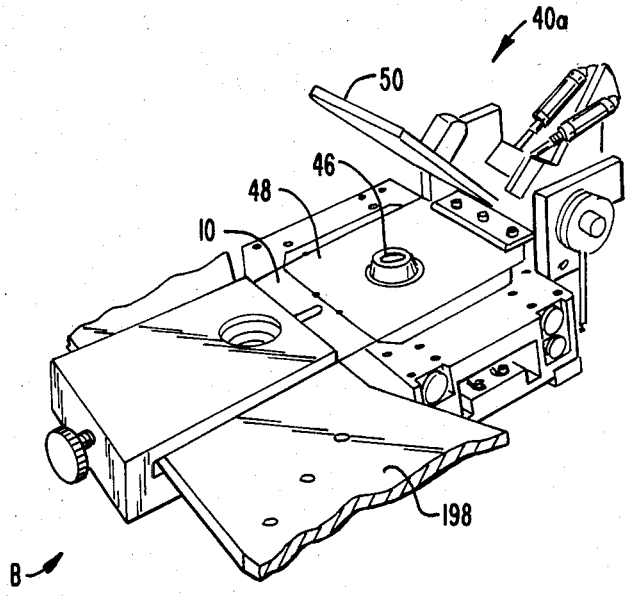

After the envelope blank 10 is in position (although not yet aligned), the mandrel 48 is lowered by the mandrel lowering assembly 123 (FIG. 3I). See FIG. 9B. The mandrel 48 holds the envelope blank 10 in place as the platform assembly **40*a* is advanced to the alignment station B. As illustrated in FIG. 9C as platform assembly 40*a* arrives at alignment station B, the alignment spindel 206 is in its retracted position so that the envelope blank 10 can slide into the gap 210 between the amntle 198 and the top enclosure 204 (FIG. 5B). After the envelope blank 10 is in place, the mandrel 48 is raised by alignment mandrel assembly 135, as described in referenced to FIG. 3J. After the mandrel 48 is raised, the alignment spindle 206 is raised to properly position the envelope blank 10 relative to the platform assembly 40*a*. The mandrel 48 is then lowered by retracting the camming block 136 of alignment mandrel assembly 135. After the mandrel 48 is lowered, (as illustrated in FIG. 9D), the spindle 206 is lowered and the envelope blank 10** is advanced to the first folding station C.

Figure 9E:
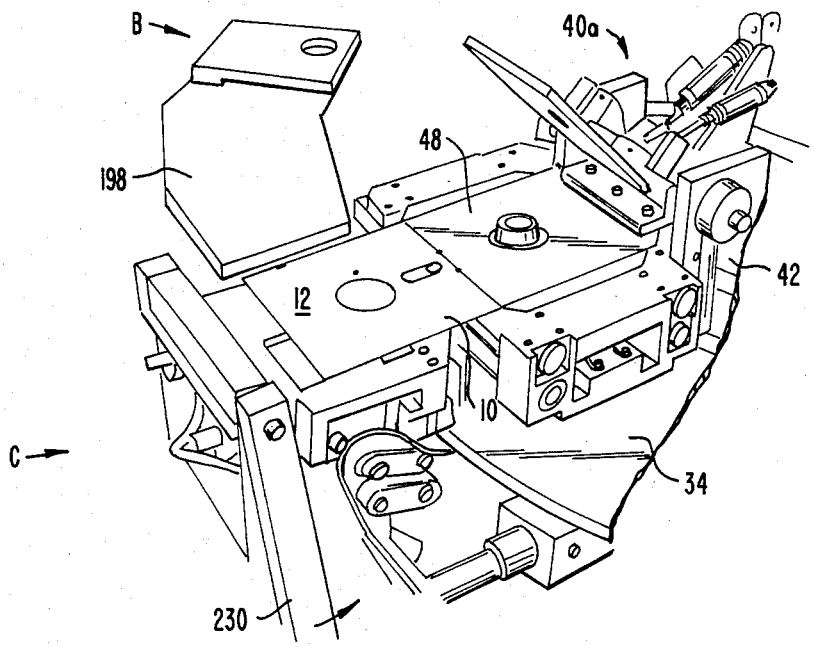
Figure 9F:
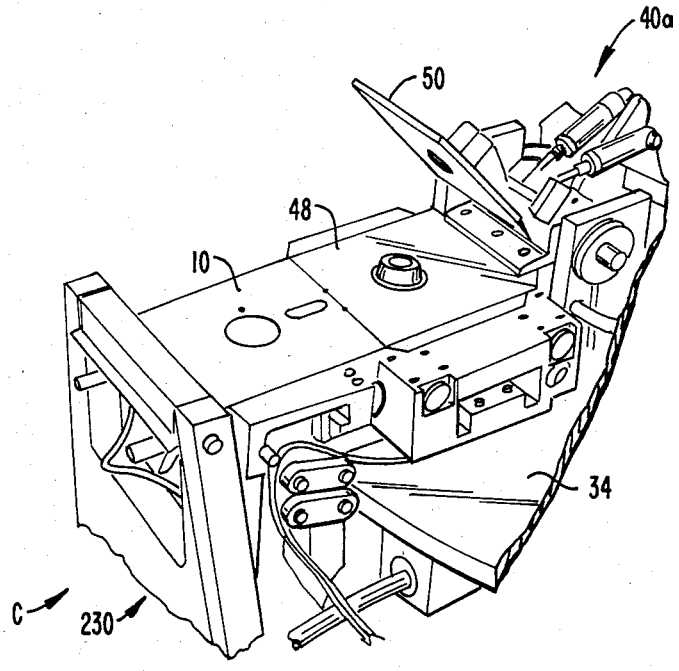
Figure 9G:
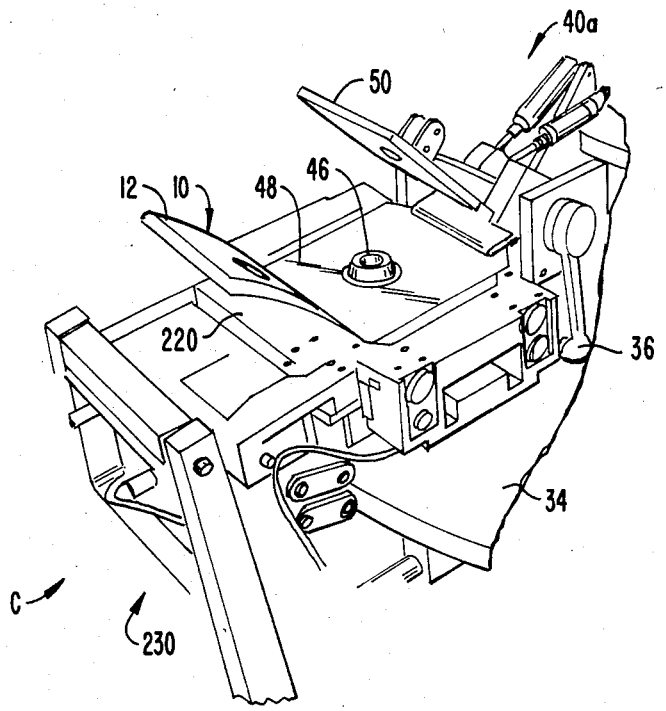
Figure 9H:
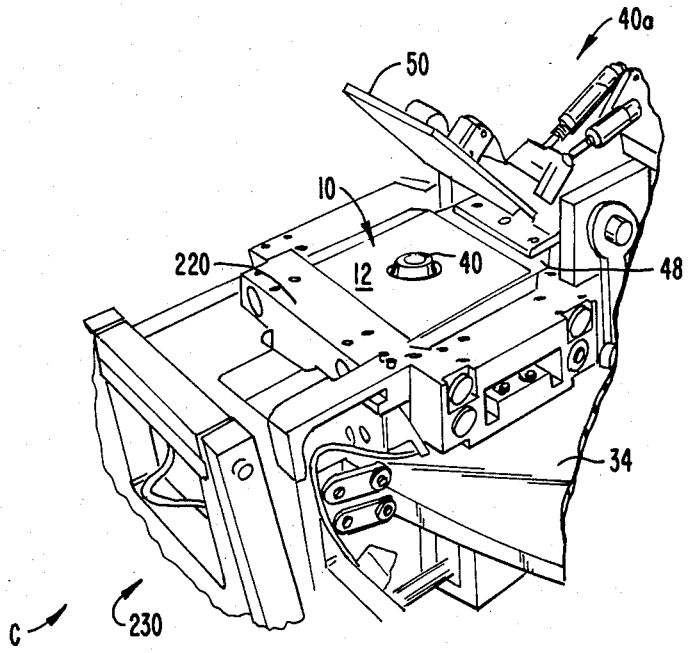

Referring now to FIGS. 9E–9I, the transverse folding operation will be described in detail. Face 12 of the envelope blank 10 initially is positioned on top of folding bar 220 (FIG. 6) as the platform assembly **40*a* arrives at station C. The upright support frame 230 is initially positioned away from the center of the machine (as illustrated in FIG. 9E) to allow clearance for entry of the envelope blank 10. Thereafter, the upright support frame 230 is moved inward by air cylinder 246 to the position illustrated in FIG. 9F. As the upright support frame 230 is brought in, the heater blade blade 266 is raised to contact the envelope blank 10 along the transverse fold line 20**.

Figure 9I:
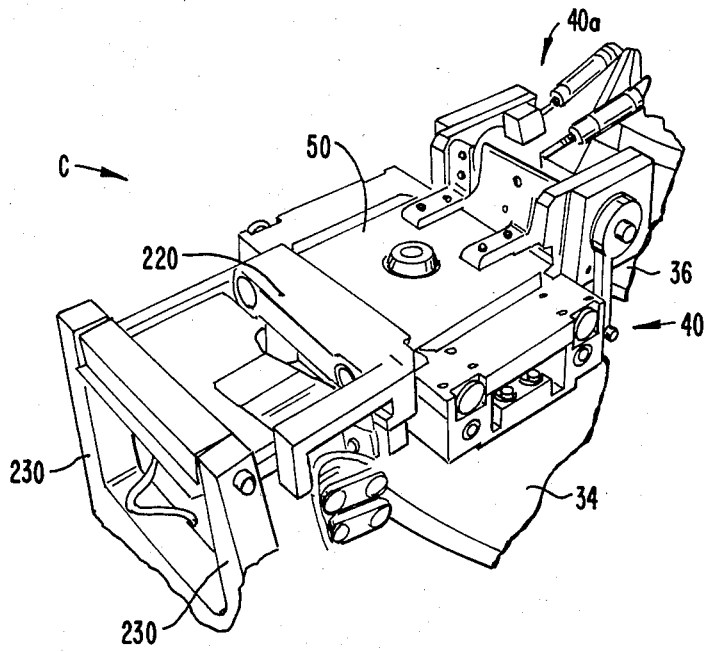

The heater blade 266 is then retracted as the folding bar 220 is raised (FIG. 9G). This causes the face 12 of envelope blank 10 to fold upward approximately 90° over the mandrel 48 along the heated fold line 20. After the fold bar 220 is fully raised, the bar is brought forward to complete the 180° fold, as illustrated in FIG. 9H. At this point, face 12 of envelope blank 10 has been brought down on top of the mandrel 48. The clamp member 50 is then lowered by the clamp actuator assembly 160 (FIG. 3L), as illustrated in FIG. 9I. Before advancing the platform assembly **40*a* to the side folding station D, the folding bar 220 and the upright support frame 230 are both retracted to the positions illustrated in FIG. 9E**.

Figure 9J:
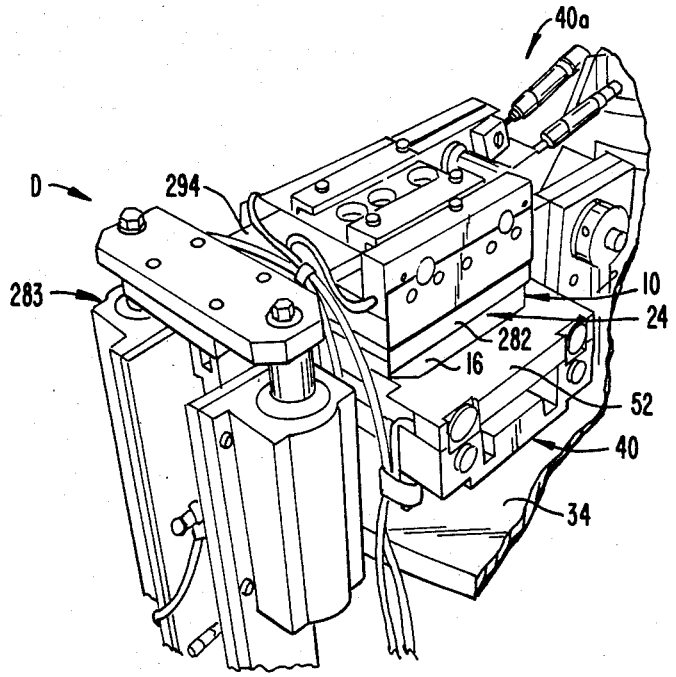
Figure 9K:
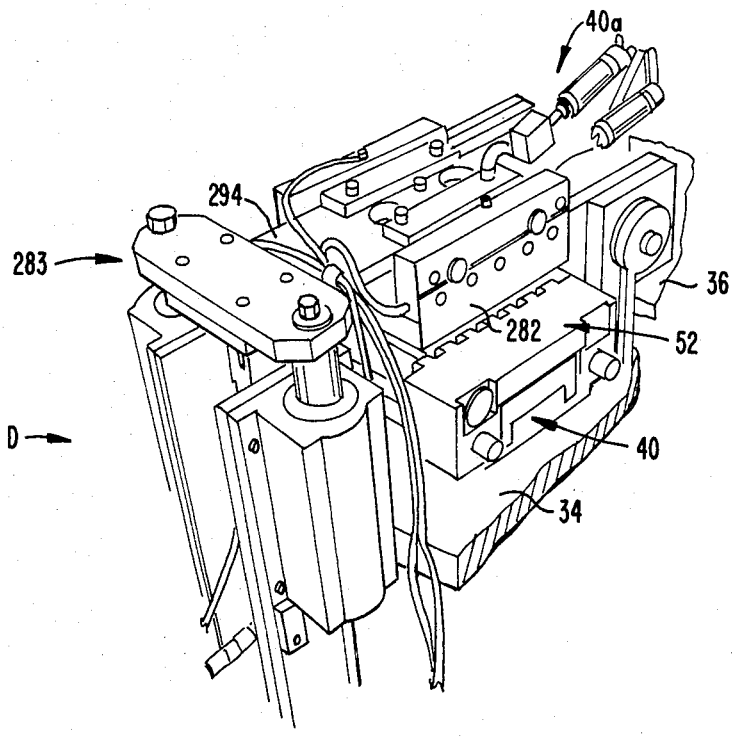

After the platform assembly **40*a* is properly positioned at the second folding station D, heated knives 282 are lowered into position by reciprocatable assembly 283 (FIG. 9J). The heated blades 282 contact the envelope along fold lines 24. After the heated blades 282 are raised, actuator mechanism 80 at station D raises the flap clamps 52 to fold side flaps 16 upward and inward. After the clamps 52 have been positioned on the side flaps 16 to hold them in place (as illustrated in FIG. 9K), the platform assembly 40*a*** is advanced to heat stake station E.

Figure 9L:
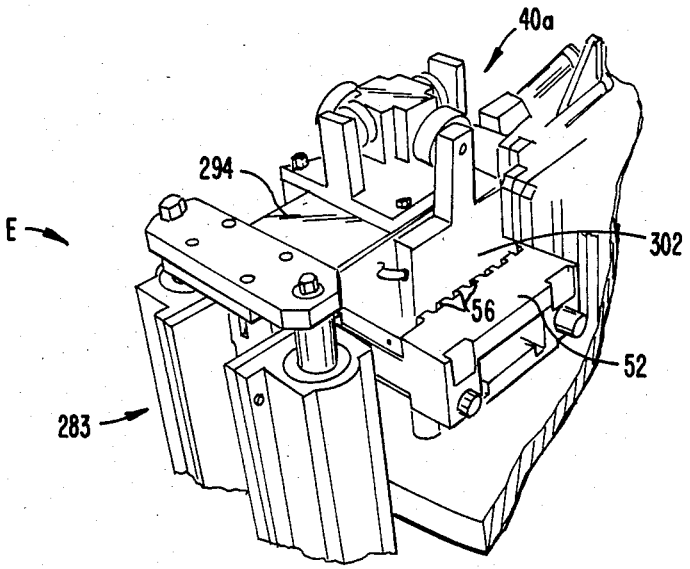

The heat stake station E is illustrated in FIG. 9L. The heat stake blades 302 and 304 are lowered onto the side flaps 16 of the envelope, with individual heat stakes 306 interdigitating with the apertures 56 formed in the flap clamps 52. By heat staking the envelope while the flap clamps 52 are in place, it is assured that the flaps 16 will remain immobilized during and after the heat stake operation. Moreover, because the flap clamps 52 remain in place until they are released at the discharge station H, sufficient time is provided for the heat stake junctions to set without having to hold the envelope at the heat stake station E (which would delay advancing the platform assemblies 40 and increase the cycle time of the system 30).

In the preferred embodiment, station F has been left empty, and no manipulation of the envelope is performed. It will at times be desirable, however, to provide a marking station at location F, to imprint desired information on the envelopes being produced. Such marking station is particularly useful for providing serial numbers, lot numbers, and the like identifying the particular batch or production run being processed. Alternatively, a heat stake assembly could be provided at this location. By then moving the second fold assembly to station E, a gluing station (not illustrated) could be provided at station D, ahead of the second folding station. In this way, the system could provide either heat staking or gluing to seal the side flaps 16.

Station G is the maintenance and adjustment station where the platform assemblies can be mounted and removed from the system. A hole 340 in top plate 34 is provided to allow access to the bottom of the platform assemblies 40. In this way, the platform assemblies do not have to be removed from the circular table 36 in order to be adjusted or repaired.

Figure 9M:
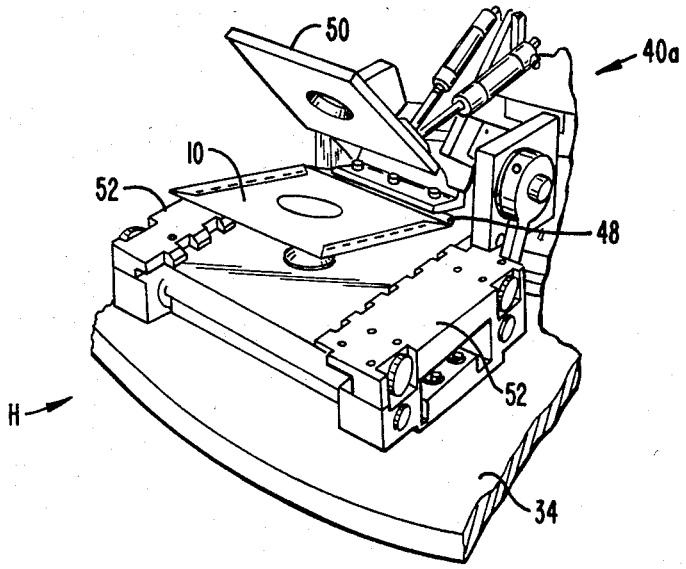

Discharge station H is illustrated in FIG. 9M. The mandrel opening assembly 143, located beneath plate 34 at station H, opens the mandrel 48. Opening of the mandrel 48, in turn, forces the clamp member 50 to open, so that both the clamp member and the mandrel are raised. The folded envelope 10, which is carried upward by the mandrel 48, is then removed from the folding machine and transported to the disk insertion mechanism. Typically, the folded envelope will be removed by an automatic removal apparatus, but such removal apparatus does not form part of the present invention.

Although the foregoing invention has been described in some detail by way of illustration and example for purposes of clarity of understanding, it will be obvious that certain changes and modifications may be practiced within the scope of the appended claims.

What is claimed is:

1. An apparatus for folding and sealing envelope blanks having two faces and pair of flaps for closing the faces; said apparatus comprising:

a support frame;

a circular table rotatably mounted on the support frame;

means for incrementally rotating the table through a preselected angle;

a plurality of platform assemblies mounted along the periphery of the circular table at intervals equal to the preselected angle, each of said platform assemblies including means for receiving and clamping envelope blanks in place and means for folding the flaps of the envelope blank inward, wherein said means for folding the flaps inward includes a pair of flap clamps, a pair of levers pivotally mounted at one end on the platform assembly with each lever having a cam surface formed therein, and a rotatable coupling member having a pair of rollers which engage the cam surfaces on the levers, whereby rotation of the coupling member in one direction causes the flap clamps to move upward and inward to fold the side flaps and rotation in the other direction causes the flap clamps to disengage the side flaps; and a multiplicity of stationary assemblies mounted on the support frame adjacent the periphery of the circular table at intervals equal to the preselected angle, said stationary assemblies including:

(a) a transverse folding assembly for folding the faces of the envelope blanks together;

(b) a flap folding assembly for actuating the flap folding means on the platform assemblies to simultaneously fold the envelope flaps to close the faces together, said flap folding assembly including a first actuator for closing the flap clamps on the side flaps of the envelope, said first actuator comprising a double-acting cylinder having a spool which engages the coupling member on the flap folding means when the cylinder is extended and means for rotating the spool in the one direction when it is engaged to the coupling member;

(c) a sealing assembly for sealing the flaps to the evelopes; and (d) a discharge station including a second actuator for opening the flap clamps from the side flaps of the envelope, said second actuator having a spool which engages the coupling member on the flap folding means when the cylinder is extended and means for rotating the spool in the other direction when it is engaged to the coupling member.

2. An apparatus as in claim 1, wherein the stationary assemblies further include an alignment assembly for positioning the envelope blank on the platform assembly before the envelope is folded.

3. An apparatus as in claim 2, wherein the clamping means on the platform assemblies includes a mandrel for holding the envelope blank in place after alignment and before folding of the envelope blank.

4. An apparatus as in claim 1, wherein the stationary assemblies further include a feed station where in envelope blanks are fed onto the platform assemblies.

5. An apparatus as in claim 1, wherein the stationary assemblies further include a repair station having an opening in the support frame to allow access to the platform assembly positioned at said repair station.

6. An apparatus as in claim 1, wherein the means for rotating the table is a servo controlled motor.

7. An apparatus as in claim 1, wherein the flap clamps of means for folding the flaps of the envelope blanks are spring-mounted dies which are held in position by the springs in between the folding station and the discharge station.

8. An apparatus as in claim 7, wherein the flap folding assembly includes a pair of heated knives for heating the envelope blank along the fold lines prior to folding

9. An apparatus as in claim 1, wherein the transverse folding assembly includes (1) a heater blade for heating the envelope blank along the fold line prior to folding, (2) a folding die, and (3) means for actuating the folding die to complete the desired transverse fold.

10. An apparatus as in claim 1, wherein the sealing assembly comprises (1) a plurality of heat stakes, and (2) means for reciprocating the heat stakes.

* * * * *